US008385792B2

(12) United States Patent
Miyajima

(10) Patent No.: US 8,385,792 B2
(45) Date of Patent: Feb. 26, 2013

(54) IMAGE INFORMATION DETECTING APPARATUS

(75) Inventor: Yu Miyajima, Utsunomiya (JP)

(73) Assignee: Canon Kabushiki Kaisha (JP)

( * ) Notice: Subject to any disclaimer, the term of this patent is extended or adjusted under 35 U.S.C. 154(b) by 255 days.

(21) Appl. No.: 12/972,029

(22) Filed: Dec. 17, 2010

(65) Prior Publication Data

US 2011/0150508 A1 Jun. 23, 2011

(30) Foreign Application Priority Data

Dec. 21, 2009 (JP) ..... 2009-289223
Oct. 22, 2010 (JP) ..... 2010-237093

(51) Int. Cl.
*G03G 15/01* (2006.01)
*G03G 15/00* (2006.01)

(52) U.S. Cl. ..... 399/301; 399/49; 399/72; 399/74

(58) Field of Classification Search ..... 399/49, 399/74, 301
See application file for complete search history.

(56) References Cited

U.S. PATENT DOCUMENTS 6,128,459 A * 10/2000 Iwata et al. ..... 399/301
6,285,849 B1 * 9/2001 Shimada et al. ..... 399/301
7,630,653 B2 * 12/2009 Bonino ..... 399/15
2004/0258437 A1 * 12/2004 Kakutani et al. ..... 399/301
2009/0067858 A1 * 3/2009 Ishibashi ..... 399/39
2009/0074438 A1 * 3/2009 Kawada et al. ..... 399/51
2010/0098471 A1 * 4/2010 Satoh et al. ..... 399/361

FOREIGN PATENT DOCUMENTS

JP 7-36244 A 2/1995
JP 2001-92195 A 4/2001

* cited by examiner

*Primary Examiner* — David Gray
*Assistant Examiner* — Tyler Hardman
(74) *Attorney, Agent, or Firm* — Rossi, Kimms & McDowell LLP

(57) ABSTRACT

An image information detecting apparatus comprises a light source comprising a light emitting surface, an image bearing member, a light receiving unit comprising a light receiving surface, an illumination optical system for causing the light emitting surface and the image bearing member to have a conjugate relationship and illuminating a pattern for detecting the overlap positional deviation with a beam; and a light receiving optical system for causing the image bearing member and the light receiving surface to have a conjugate relationship and guiding the beam for detecting the overlap positional deviation to the light receiving unit, wherein a straight line portion of a conjugate image of the light emitting surface on the image bearing member and a straight line portion of a conjugate image of the light receiving surface on the image bearing member are parallel with each other.

11 Claims, 14 Drawing Sheets

IMAGE INFORMATION DETECTING APPARATUS

BACKGROUND OF THE INVENTION

1. Field of the Invention

The present invention relates to an image information detecting apparatus used for a color image forming apparatus such as a copier, a printer, or a facsimile machine to which an electrophotographic process or an electrostatic recording process is applied, and more particularly, to an image information detecting apparatus for detecting a position of a pattern.

2. Description of the Related Art

In a conventional image forming apparatus for obtaining a multiple color image, in general, images having different colors are formed in multiple image forming sections, paper is transported by a transport unit such as a conveyor belt, and the images are transferred onto the paper and overlapped each other to thereby perform multiple color image formation. In particular, in a case of obtaining a full color image by performing multiple color developing, even a slight overlap positional deviation deteriorates image quality. For example, in a case of 400 dpi, even an overlap positional deviation of a fraction of 63.5 μm corresponding to one pixel appears as a change of a color misregistration or a color tint variation and significantly deteriorates an image.

In the initial stage of development of a color image forming apparatus, the multiple color developing is performed by optical scanning with a single image forming section, that is, the same optical characteristic, thereby alleviating the overlap positional deviation of images. However, this method has a problem of requiring much time to output a multiplexed image or a full color image.

In order to solve this problem, there is a method of forming images by different optical scanners so as to separately obtain images of respective colors and overlaying the images of the respective colors one on another on the paper transported by a transport section. However, this method raises a concern about a color misregistration caused when overlaying the images.

Therefore, an image information detecting apparatus for detecting the color misregistration is proposed. In the image information detecting apparatus, a beam emitted from a light emitting surface of a light source unit is condensed by a condensing part and an illumination lens, and a pattern for position detection depicted on an image bearing member being a transferring belt is illuminated with the condensed beam via dustproof glass. Then, specular reflection light from the image bearing member and the pattern depicted thereon is detected by a light receiving unit via a stop and an imaging lens. An image forming section (image forming unit) is controlled to output images of respective colors according to detection signals detected by the light receiving unit.

In order to obtain an image with high accuracy, it is necessary to also refer to accuracy of the image information detecting apparatus. One of the causes for deterioration of the accuracy of the image information detecting apparatus is noise present in a detection signal. As a method for improving a signal-to-noise ratio of the detection signal, there are a method of increasing a received light quantity and a method of reducing noise.

For example, Japanese Patent Application Laid-Open No. 2001-092195 discloses a case of improving the signal-to-noise ratio of the detection signal by adjusting an exposure time. Japanese Patent Application Laid-Open No. H07-036244 discloses a case of improving the signal-to-noise ratio of the detection signal by containing the light receiving unit inside a casing made of metal to thereby reduce noise.

Further, as unit for improving the signal-to-noise ratio of the detection signal, there is a method of illuminating the pattern on the image bearing member with high brightness by selecting an LED having a large optical output or selecting an LED having a high directivity.

In addition, as a method of illuminating the pattern on the image bearing member with high brightness, there is a method of using critical illumination in which the light emitting surface and the image bearing member have a substantially conjugate relationship. In the critical illumination, a small region near the pattern is illuminated in comparison with the conventional method of illuminating a large region including the pattern, which allows light emitted from the light emitting surface to illuminate the pattern with high efficiency.

However, the image information detecting apparatus using the critical illumination has a problem that position detecting accuracy is liable to deteriorate at an occurrence of a positioning error of a constituent element or a positioning error of the image information detecting apparatus itself. If color misregistration is corrected by using such an image information detecting apparatus, a color image forming apparatus that exhibits color misregistration correction performance with stability cannot be provided due to an individual difference of the image information detecting apparatus or an environmental change.

SUMMARY OF THE INVENTION

Therefore, an object of the present invention is to provide an image information detecting apparatus in which detecting accuracy of a pattern hardly deteriorates due to a positioning error of a constituent element included in the image information detecting apparatus or a positioning error of the image information detecting apparatus itself in a case where a light emitting surface of an illumination system and an image bearing member have a substantially conjugate relationship.

According to an aspect of the present invention, there is provided an image information detecting apparatus for detecting an overlap positional deviation of images in a color image forming apparatus including multiple photosensitive drums, the image information detecting apparatus including; a light source including a light emitting surface having a quadrangular shape, an image bearing member that moves in a predetermined direction, a light receiving unit including a light receiving surface having a quadrangular shape, an illumination optical system for causing the light emitting surface of the light source and the image bearing member to have a conjugate relationship and illuminating a pattern for detecting the overlap positional deviation, which is formed on the image bearing member, with a beam emitted from the light source; and a light receiving optical system for causing the image bearing member and the light receiving surface of the light receiving unit to have a conjugate relationship and guiding the beam reflected by the pattern for detecting the overlap positional deviation to the light receiving unit, in which; a straight line portion of a conjugate image of the light emitting surface on the image bearing member which defines a contour of the conjugate image of the light emitting surface, and a straight line portion of a conjugate image of the light receiving surface on the image bearing member which defines a contour of the conjugate image of the light receiving surface, are parallel with each other.

According to still another aspect of the present invention, there is provided an image information detecting apparatus for detecting an overlap positional deviation of images in a color image forming apparatus including multiple photosensitive drums, the image information detecting apparatus including; a light source including light emitting surface having a quadrangular shape, an image bearing member that moves in a predetermined direction, a light receiving unit including a light receiving surface having a quadrangular shape, an illumination optical system for causing the light emitting surface of the light source and the image bearing member to have a conjugate relationship and illuminating a pattern for detecting the overlap positional deviation, which is formed on the image bearing member, with a beam emitted from the light source; and a light receiving optical system for causing the image bearing member and the light receiving surface of the light receiving unit to have a conjugate relationship and guiding the beam reflected by the pattern for detecting the overlap positional deviation to the light receiving unit, in which; the following expression is satisfied; $|\theta a-\theta b| \leqq 13°$ where $\theta a$ represents an angle formed between a moving direction of the image bearing member and a straight line portion of a conjugate image of the light emitting surface which defines a contour of the conjugate image of the light emitting surface on the image bearing member, and $\theta b$ represents an angle formed between the moving direction of the image bearing member and a straight line portion of a conjugate image of the light receiving surface which defines a contour of a conjugate image of the light receiving surface on the image bearing member. According to a further aspect of the present invention, in the image information detecting apparatus, a principal ray of the light beam emitted from the light source perpendicularly enters the image bearing member. According to a further aspect of the present invention, in the image information detecting apparatus, the light emitting surface and the light receiving surface have one of a rectangular shape and a square shape.

According to a further aspect of the present invention, in the image information detecting apparatuses described above, the light emitting surface has a shape of a square, each side of which has a length of $q_1$, the light receiving surface has a shape of a square, each side of which has a length of $q_2$; and the following expression is satisfied;

$$|\beta_1| \times q_1 < 1.7 \times \frac{q_2}{|\beta_2|}$$

where $\beta_1$ represents an optical magnification of the illumination optical system on an assumption that the light emitting surface is an object point and that a surface of the image bearing member is an image plane, and $\beta_2$ represents an optical magnification of the light receiving optical system on an assumption that the surface of the image bearing member is an object point and that the light receiving surface is an image plane.

According to a further aspect of the present invention, in the image information detecting apparatuses described above, one of the following expressions is satisfied:

$$1.2 \leq \frac{|\beta_1| \times |\beta_2| \times q_1}{q_2}$$

and

-continued $$1.2 \leq \frac{q_2}{|\beta_1| \times |\beta_2| \times q_1}.$$

According to another aspect of the present invention, there is provided a color image forming apparatuses described above including; the image information detecting apparatus set up in the foregoing; and multiple photosensitive drums.

According to the present invention, it is possible to provide an image information detecting apparatus employing critical illumination, which solves the problem that position detecting accuracy is liable to deteriorate at an occurrence of the positioning error of the constituent element or the positioning error of the image information detecting apparatus itself and which can exhibit the color misregistration correction performance with stability independent of the individual difference of the image information detecting apparatus or the environmental change.

Further, no introduction of a new member is necessary in order to obtain an effect, which is beneficial in terms of cost.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1:
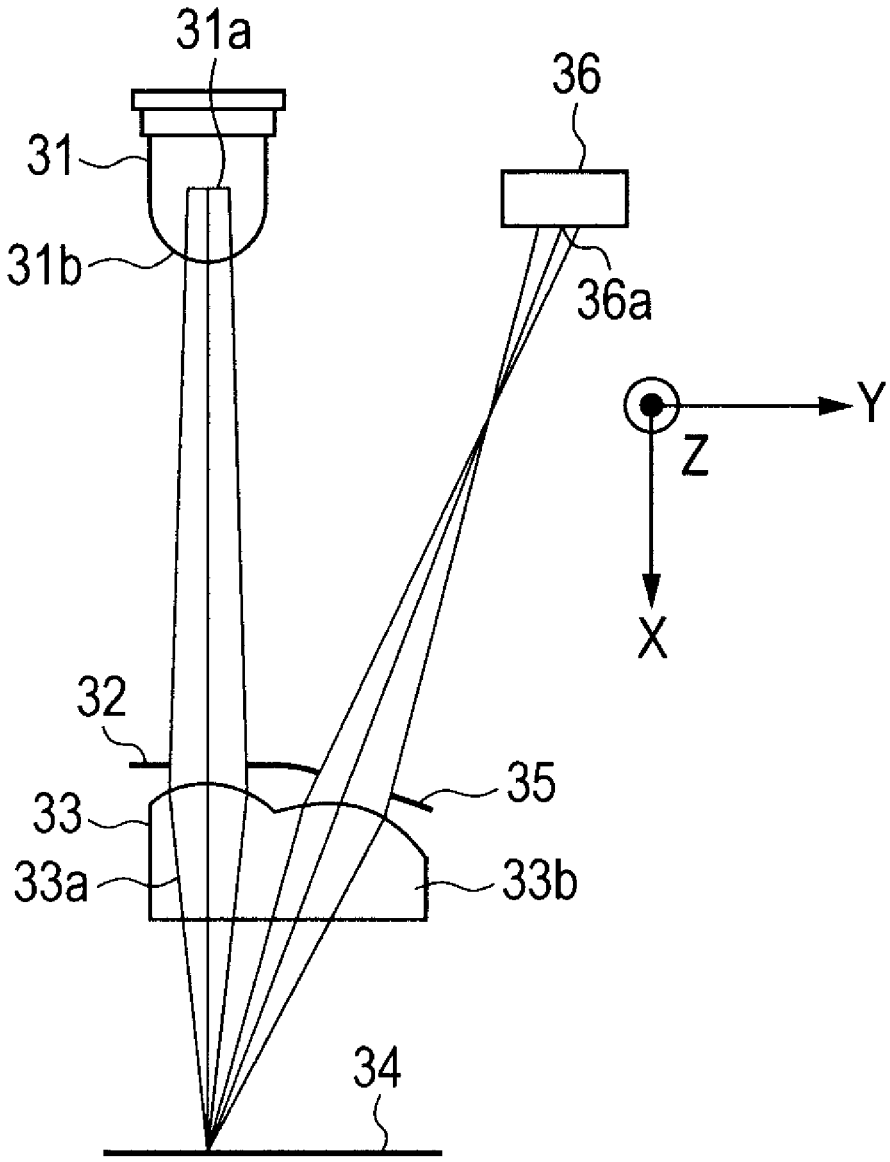
FIG. 1 is a schematic diagram of a main portion of an image information detecting apparatus according to a first embodiment of the present invention.

FIG. 1 is a sub-scanning sectional view of a main portion of an image information detecting apparatus according to a first embodiment of the present invention. With reference to FIG. 1, a configuration of the image information detecting apparatus is described.

The image information detecting apparatus includes an illumination unit, an illumination optical system, a transferring belt, a light receiving optical system, and a light receiving unit.

The illumination unit includes an LED light source 31. A shape of a light emitting surface 31*a* of the LED light source 31 is a square of 0.35 mm on one side. A beam emitted from the light emitting surface 31*a* is condensed at a condensing part 31*b*.

The illumination optical system includes a stop 32 and an illumination lens 33*a*. The beam emitted from the light source 31 is limited by the stop 32. An optical element 33 is an optical element which is integrally formed by the illumination lens 33*a* serving as the illumination optical system and an imaging lens 33*b* serving as the light receiving optical system both of which are made of the same material.

A principal ray of the beam emitted from the light source 31 perpendicularly enters a surface of a transferring belt 34. A pattern for position detection, which is formed of respective colors, is transported by the transferring belt 34 serving as an image bearing member. The pattern for position detection formed on the transferring belt 34 (the image bearing member) is illuminated by the beam emitted from the light source 31 passing through the illumination optical system.

The light receiving optical system includes the imaging lens 33*b* and a stop 35. A part of light scattered by the pattern formed on the transferring belt 34 is condensed by the imaging lens 33*b*, limited by the stop 35, and received by a light receiving element 36 serving as a light receiving unit. A shape of a light receiving surface 36*a* of the light receiving element 36 is a square of 1 mm on one side.

In FIG. 1, a direction perpendicular to the surface of the transferring belt 34 is set as an X direction, a direction parallel to the drawing sheet and perpendicular to the X direction is set as a Y direction, and a direction perpendicular to the drawing sheet is set as a Z direction. The Y direction is a main scanning direction of an image forming apparatus, and the Z direction is a sub scanning direction of the image forming apparatus. The Z direction is a transport direction of the transferring belt which is a direction along which the pattern for position detection (overlap positional deviation detection pattern) moves.

As the transferring belt 34 transports the pattern for position detection (overlap positional deviation detection pattern), a received light quantity changes. A formation position of the pattern for position detection (overlap positional deviation detection pattern) is detected from a detection signal of the received light quantity, and a formation positional deviation amount from a reference position is calculated. It is necessary to improve a signal-to-noise ratio of the detection signal because noise present in the detection signal causes a problem when the formation positional deviation amount is calculated. As a method for improving the signal-to-noise ratio of the detection signal, there is a method of increasing the received light quantity. In order to efficiently illuminate an illuminated position with a beam emitted from a light source for the purpose of increasing the received light quantity, in the illumination optical system, the light emitting surface 31*a* and the surface of the transferring belt 34 are caused to have a substantially optical conjugate relationship by the condensing part 31*b* of the light source 31 and the illumination lens 33*a* of the illumination optical system.

A magnification $\beta_1$ of the illumination optical system is defined by assuming that the light emitting surface 31*a* is an object point and that the surface of the transferring belt 34 is an image plane. In this system, $\beta_1=-2.6$.

Figure 2A:
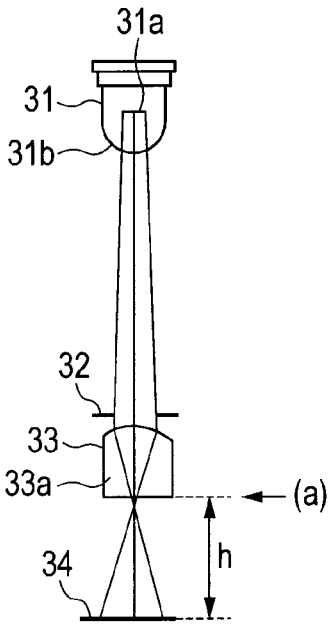
FIG. 2A is a diagram illustrating a beam obtained when a conjugate plane position of a light emitting surface is a position (a) on a transferring-belt-side surface of an illumination lens 33*a* in the image information detecting apparatus according to the first embodiment of the present invention.
Figure 2B:
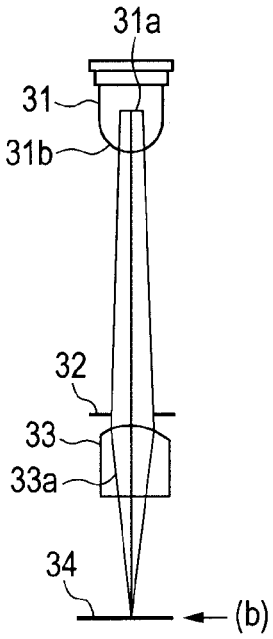
FIG. 2B is a diagram illustrating a beam obtained when the conjugate plane position of the light emitting surface is a position (b) of a surface of a transferring belt 34 in the image information detecting apparatus according to the first embodiment of the present invention.
Figure 2C:
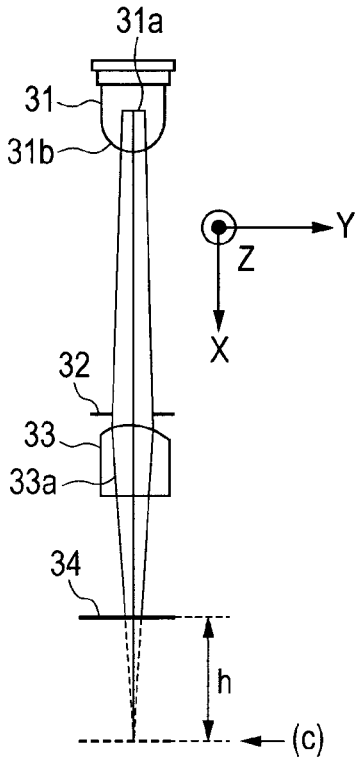
FIG. 2C is a diagram illustrating a beam obtained when the conjugate plane position of the light emitting surface is a position (c) spaced apart from the transferring belt in a direction opposite to a light source by a distance h corresponding to a distance between the illumination lens 33*a* and the transferring belt 34 in the image information detecting apparatus according to the first embodiment of the present invention.
Figure 3:
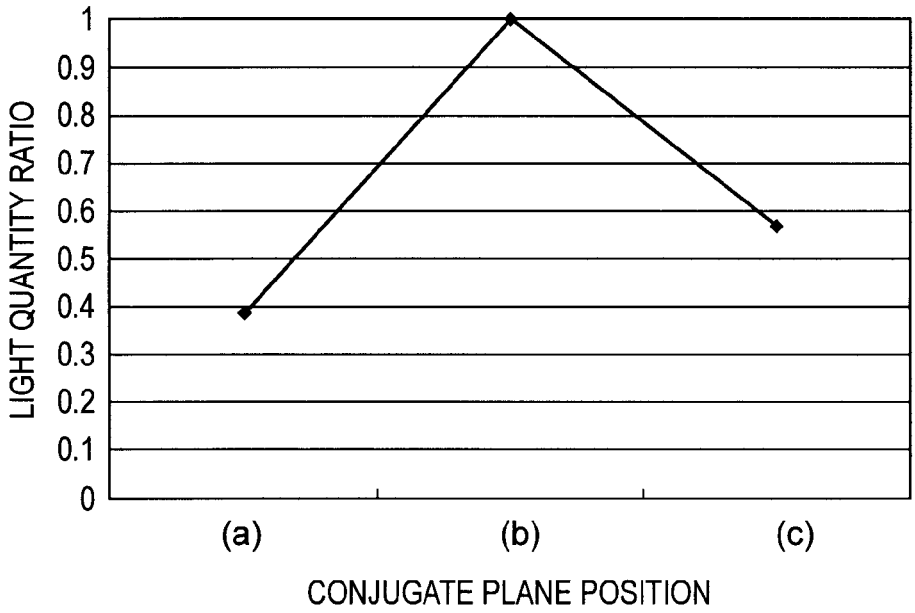
FIG. 3 is a graph illustrating an irradiation light quantity ratio obtained when the conjugate plane is changed in the image information detecting apparatus according to the first embodiment of the present invention.

FIGS. 2A, 2B, 2C, and 3 are used to describe effectiveness of the above-mentioned illumination in increasing the received light quantity. FIGS. 2A, 2B, and 2C illustrate beams of the illumination optical system, with a conjugate plane position of the light emitting surface 31*a* being a position (a)

of a back surface of the illumination lens 33*a* (FIG. 2A), a position (b) of the surface of the transferring belt 34 (FIG. 2B), and a position (c) spaced apart from the surface of the transferring belt 34 in a direction opposite to the light source by a distance h corresponding to a distance between a front surface of the illumination lens 33*a* and the surface of the transferring belt 34 (FIG. 2C), respectively. Of those cases, as illustrated in FIG. 3, a light quantity ratio at which a light receiving region of the surface of the transferring belt 34 is illuminated is largest when the conjugate plane is set on the transferring belt 34.

Here, having a "substantially optical conjugate relationship" described above refers to having such a relationship between the object point and the image plane that the following expression is established:

$$|\Delta|<0.3L \quad (1)$$

where L represents a distance between the object point and a paraxial image plane, and Δ represents a distance between the paraxial image plane and a real image plane. When the above-mentioned expression is satisfied, a conjugate image of the object point is projected onto the image plane.

When the above-mentioned relationship is satisfied, a light emitting surface conjugate image 111 (FIG. 4) serving as the substantially conjugate image of the light emitting surface 31*a* (object point) is projected onto the surface of the transferring belt 34 (image plane). Therefore, the shape of the light emitting surface 31*a* affects a signal detected by the light receiving surface 36*a*. The light emitting surface 31*a* is square, and hence the light emitting surface conjugate image 111 is square.

For the same purpose as the illumination optical system, also in the light receiving optical system, the surface of the transferring belt 34 and the light receiving surface 36*a* are caused to have a substantially optical conjugate relationship by the imaging lens 33*b*. The substantially optical conjugate relationship produces an effect that a sensitivity of the received light quantity with respect to an inclination of the surface of the transferring belt 34 is reduced.

A magnification $\beta_2$ of the light receiving optical system is defined by assuming that the surface of the transferring belt 34 is the object point and that the light receiving surface 36*a* is the image plane. In this system, $\beta_2=-1.4$.

A light receiving surface conjugate image 112 (FIG. 4) is considered, which is a substantially conjugate image obtained by assuming that the light receiving surface 36*a* is the object point and that the surface of the transferring belt 34 is the image plane. The light receiving element 36 receives scattered light from the region of the light receiving surface conjugate image 112. Therefore, the shape of the light receiving surface 36*a* affects a signal detected by the light receiving surface.

The light receiving optical system according to this system is located with an angle of 25° with respect to the perpendicular direction (−X direction) of the surface of the transferring belt 34. Therefore, the light receiving surface conjugate image 112 exhibiting different magnifications in the main scanning direction within its region does not have a precise square shape but has a distorted shape. However, this does not cause a problem in the description of the effect of the present invention, and hence the description is made hereinbelow on the assumption that the light receiving surface conjugate image 112 is square.

Figure 4:
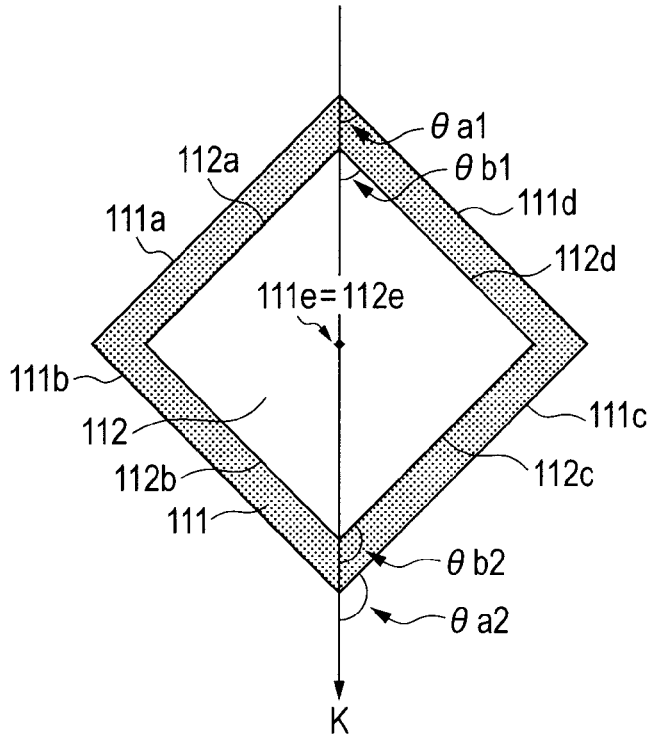
FIG. 4 is an explanatory diagram of a light emitting surface conjugate image 111 and a light receiving surface conjugate image 112.

FIG. 4 illustrates the light emitting surface conjugate image 111 and the light receiving surface conjugate image 112 on the transferring belt 34. The light emitting surface conjugate image 111 includes four straight line portions 111*a*, 111*b*, 111*c*, and 111*d* and a light emitting surface conjugate image center position 111*e*. The straight line portions 111*a* and 111*b* are parallel with the straight line portions 111*c* and 111*d*, respectively. Angles θa1 and θa2 formed between the straight line portions 111*d* and 111*c* and the Z direction are 45° and 135°, respectively. From one side of the light emitting surface being 0.35 mm with the optical magnification $\beta_1=-2.6$, one side of the light emitting surface conjugate image 111 is calculated as 0.91 mm.

The light receiving surface conjugate image 112 includes four straight line portions 112*a*, 112*b*, 112*c*, and 112*d*, which define the contour thereof, and the light receiving surface conjugate image center position 112*e*. The straight line portions 112*a* and 112*b* are parallel with the straight line portions 112*c* and 112*d*, respectively. The light emitting surface conjugate image center position 111*e* coincides with the light receiving surface conjugate image center position 112*e*. Angles θb1 and θb2 formed between the straight line portions 112*d* and 112*c* and the Z direction are about 45° and about 135°, respectively. From one side of the light receiving surface being 1 mm with the optical magnification $\beta_2=-1.4$, one side of a contour of the light emitting surface conjugate image 112 is calculated as 0.71 mm.

Figure 5:
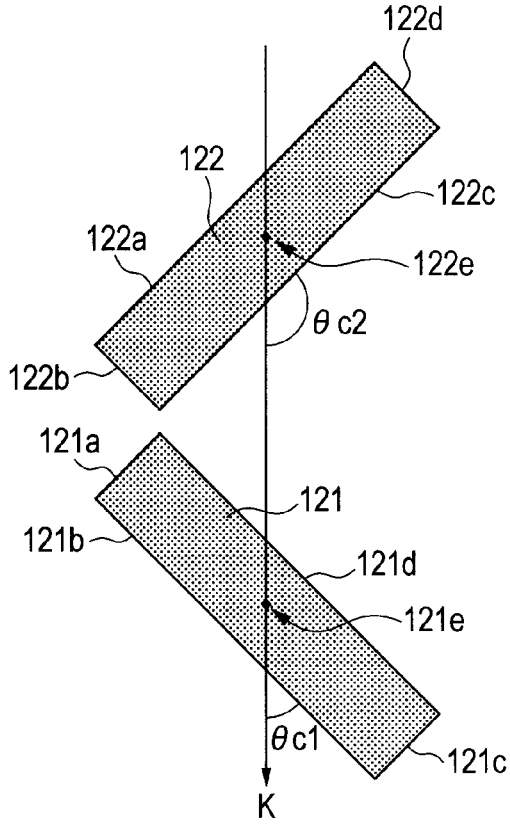
FIG. 5 is an explanatory diagram of patterns 121 and 122.

FIG. 5 illustrates two patterns 121 and 122 on the transferring belt 34. Each of the patterns 121 and 122 is rectangular, and its width in a long side direction is sufficiently larger than the widths of the light emitting surface conjugate image 111 and the light receiving surface conjugate image 112. The width in a short side direction is substantially the same as the width of the light receiving surface conjugate image 112. The pattern 121 includes four straight line portions 121*a*, 121*b*, 121*c*, and 121*d*, which define the contour of the pattern 121, and a center position 121*e*. Further, the pattern 122 includes four straight line portions 122*a*, 122*b*, 122*c*, and 122*d*, which define a contour of the pattern 122, and a center position 122*e*. The straight line portion 121*a* is parallel with the straight line portion 121*c*, and the straight line portion 122*a* of the pattern 122 is parallel with the straight line portion 122*c*. Angles θc1 and θc2 formed between the straight line portions 121*b* and 122*c* and the Z direction are 45° and 135°, respectively.

Therefore, the straight portions of the light emitting surface conjugate image 111, the straight portions of the light receiving surface conjugate image 112, and the straight portions of the patterns 121 and 122 are substantially parallel with one another.

Figure 6:
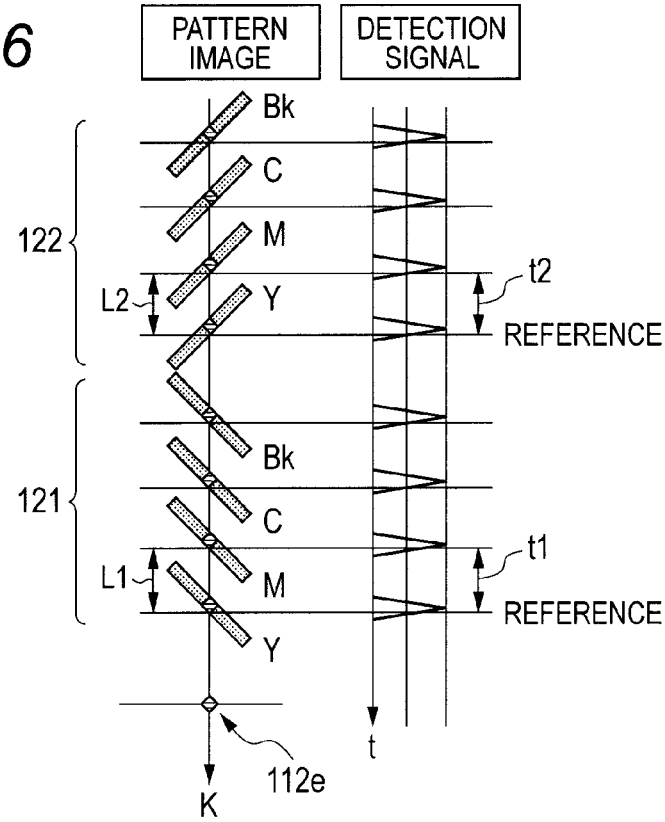
FIG. 6 is an explanatory diagram of patterns formed on an image bearing member when there is no formation positional deviation.

FIG. 6 is a diagram illustrating patterns formed on the surface of the transferring belt 34 for detecting the formation positional deviation amount of the respective colors. FIG. 6 illustrates an ideal case where no formation positional deviation occurs in the patterns. The dots inside the patterns each indicate a center position of the pattern. Here, the center position of the light receiving surface conjugate image 112 is set as a light receiving surface conjugate image center position 112*e*.

A K-axis parallel to a Z-axis is assumed. The K-axis passes the light receiving surface conjugate image center positions 112*e* and is fixed to the surface of the transferring belt 34. The patterns are arranged along the K-axis with the center positions thereof having predetermined intervals.

In FIG. 6, the patterns are arrayed in the order of yellow (Y), magenta (M), cyan (C), and black (Bk) and in the order of a pattern 121 (set of diagonally left-up patterns of the four colors) and a pattern 122 (set of diagonally right-up patterns of the four colors), but the present invention is not limited thereto. The transferring belt 34 transports the patterns at a velocity V. FIG. 6 also illustrates detection signals obtained when a corresponding K coordinate reaches the light receiving surface conjugate image center position 112*e*.

The image information detecting apparatus detects a time t when a straight line portion of the pattern passes the light receiving surface conjugate image center position 112*e*. A detection time is obtained with reference to a detection time instant of a reference color (yellow in this embodiment) pattern. Further, the K coordinate determined at the time of detection is set as a detection position. The detection position is determined with reference to the detection position of the reference color pattern.

A detection position L of the pattern is calculated from the detection time t and the velocity V as follows:

$$L=t\times V \tag{2}$$

When no formation positional deviation occurs, the patterns are arrayed at the predetermined intervals, and hence the detection position L takes a predetermined known value. This position is set as a "detection planned position".

With regard to magenta exemplified in FIG. 6, a detection position L1 of the pattern 121 is calculated from a detection time t1 as follows:

$$L1=t1\times V \tag{3}$$

A detection position L2 of the pattern 122 is calculated from a detection time t2 as follows:

$$L2=t2\times V \tag{4}$$

No formation positional deviation occurs in this example, and hence the detection positions L1 and L2 are the same as the detection planned positions, thereby being the predetermined known values.

Figure 7:
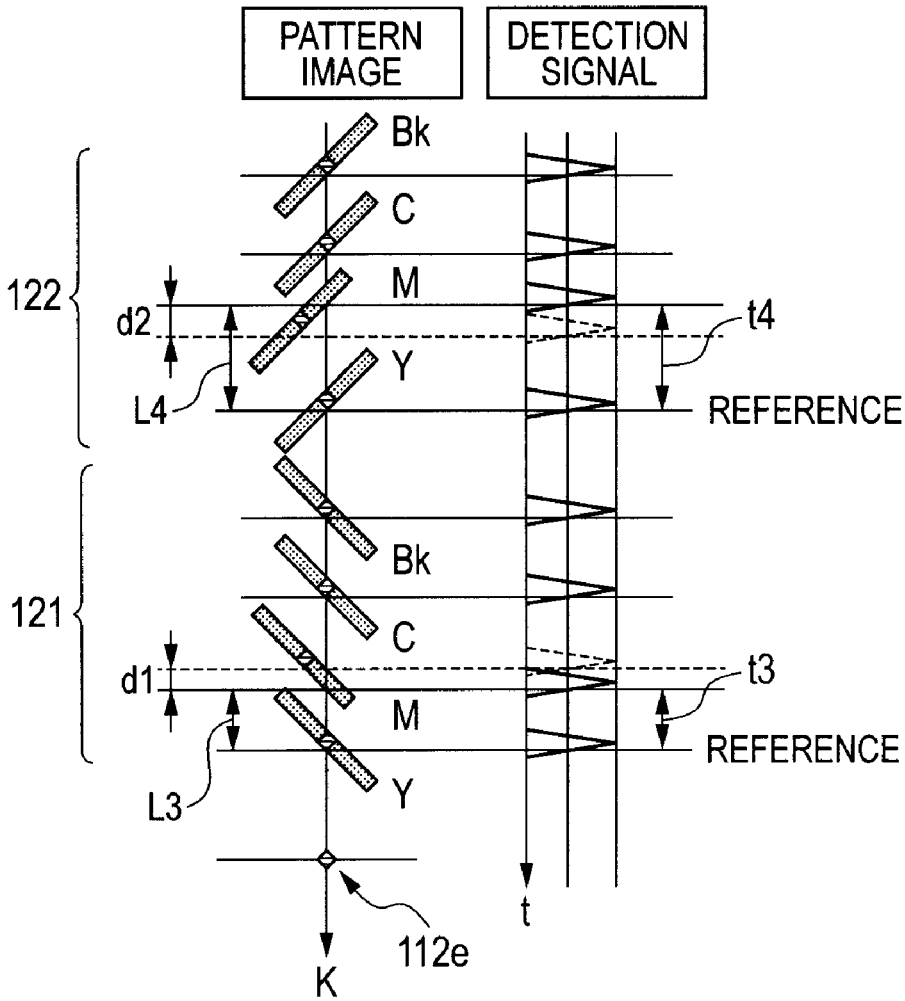
FIG. 7 is an explanatory diagram of patterns formed on the image bearing member when there is a formation positional deviation in a magenta (M) color.

FIG. 7 illustrates the patterns obtained when a formation positional deviation occurs in the magenta patterns. The deviation amount of the center position of the magenta pattern from that in the case where no formation positional deviation occurs is the formation positional deviation amount of the magenta pattern. The detection signals at this time are also illustrated. The detection positions and the detection times in the case where no formation positional deviation occurs are indicated by the dotted lines. There are deviations between the detection positions and the detection planned positions. The deviation amounts are set as "detection deviation amounts", and detection deviation amounts d1 and d2 of the patterns 121 and 122, respectively, are defined as follows:

$$d1=L3-L1=(t3-t1)\times V \tag{5}$$

$$d2=L4-L2=(t4-t2)\times V \tag{6}$$

where t3 and t4 represent the detection times of the patterns 121 and 122, respectively, and L3 and L4 represent the detection positions of the patterns 121 and 122, respectively.

From the detection deviation amounts, a formation positional deviation amount ΔY in the main scanning direction and a formation positional deviation amount ΔZ in the sub scanning direction are respectively calculated as follows:

$$\Delta Y=\frac{d1-d2}{2}=\frac{(t3-t1)-(t4-t2)}{2}\times V \tag{7}$$

$$\Delta Z=\frac{d1+d2}{2}=\frac{(t3-t1)+(t4-t2)}{2}\times V \tag{8}$$

Results thereof are respectively color misregistration amounts of magenta in the main/sub scanning directions with reference to the reference color.

Figure 8:
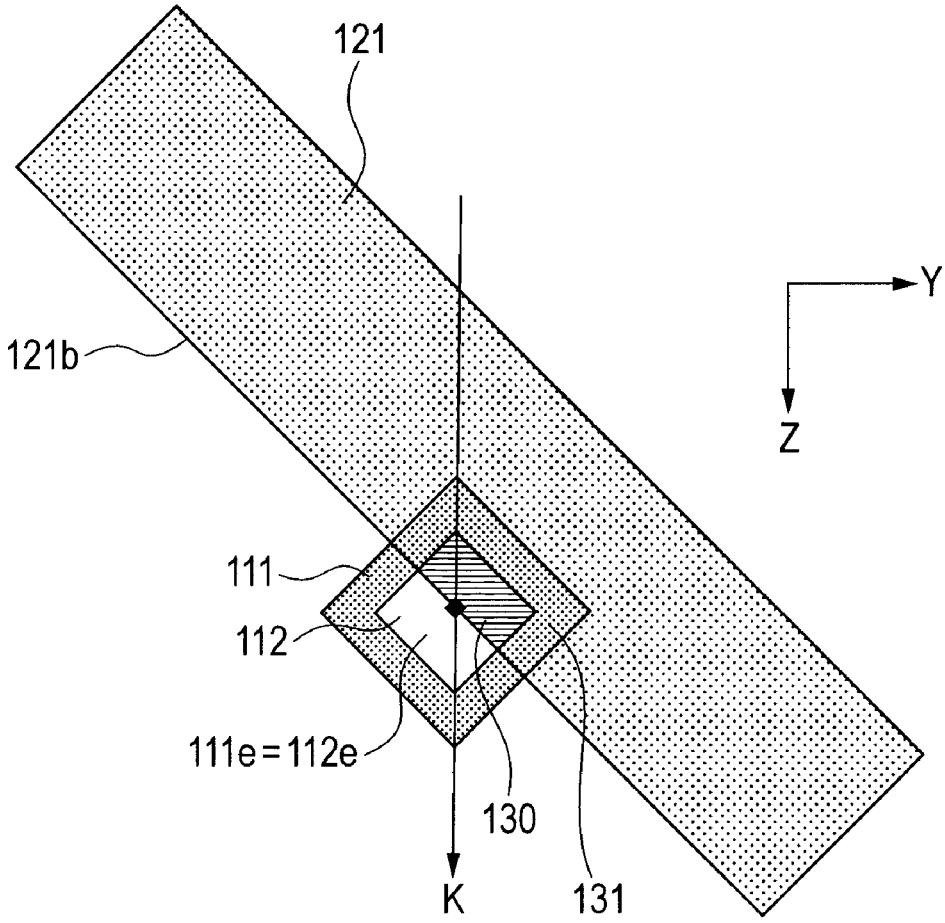
FIG. 8 is an explanatory diagram of the pattern 121, the light emitting surface conjugate image 111, and the light receiving surface conjugate image 112 on the image bearing member in a case where a straight line portion of the pattern 121 has reached a center position 112*e* of the light receiving surface conjugate image.

FIG. 8 illustrates the light emitting surface conjugate image 111, the light receiving surface conjugate image 112, and the pattern 121 on the transferring belt 34 obtained when the straight line portion 121*b* of the pattern 121 reaches the light receiving surface conjugate image center position 112*e*. When the transferring belt 34 transports the pattern, scattering occurs in an overlapped region 131 between the pattern and the light emitting surface conjugate image 111. Of the scattering light, the light receiving element 36 receives the scattering light from an overlapped region 130 between the overlapped region 131 and the light receiving surface conjugate image 112.

Here, the light emitting surface 31*a* emits light uniformly within the surface, and hence an illumination intensity distribution within the light emitting surface conjugate image 111 which is the conjugate image of the light emitting surface 31*a* is also uniform. Further, the illumination intensity distribution is extremely deteriorated outside the region of the light emitting surface conjugate image 111.

In the same manner, the sensitivity of the light receiving surface 36*a* is uniform within the light receiving surface, and hence a light receiving sensitivity distribution within the light receiving surface conjugate image 112 which is the conjugate image of the light receiving surface 36*a* is also substantially uniform. Further, there is no light receiving sensitivity outside the region of the light receiving surface conjugate image 112. The word "substantially" is added here because the light receiving surface conjugate image 112 is substantially square as discussed above.

In addition, the scattering by the pattern is substantially isotropic scattering, and hence the light quantity toward the light receiving surface is substantially proportional to the area of the scattered region. As a result, the received light quantity is substantially proportional to the area of the overlapped region 130. As the pattern moves, the area of the overlapped region 130 changes, thereby changing the received light quantity and generating a detection signal.

Before describing the present invention, the problems to be solved by the present invention are described with reference to a system comparable with this embodiment.

Figure 9:
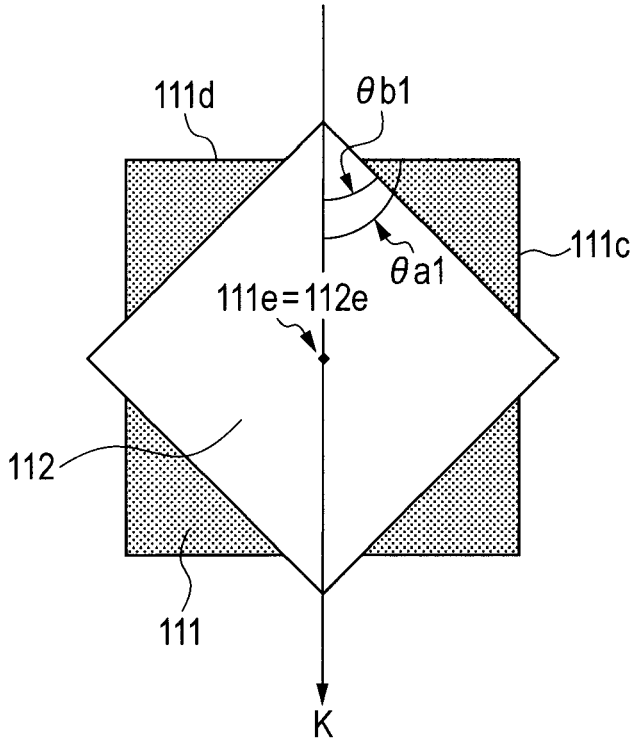
FIG. 9 is an explanatory diagram of the light emitting surface conjugate image 111, and the light receiving surface conjugate image 112 in a non-parallel system located as designed.

A system different from this embodiment only in that the angles θa1 and θa2 formed between the straight line portions 111*d* and 111*c* of the light emitting surface conjugate image 111 and the Z direction are 90° and 0°, respectively, is taken as the comparable system. FIG. 9 illustrates the light emitting surface conjugate image 111 and the light receiving surface conjugate image 112 of this system. In this case, no combination of straight line portions having a parallel relationship exists between the light emitting surface conjugate image 111 and the light receiving surface conjugate image 112. Such a system is defined as "non-parallel system". With regard to this system, an area S(k) of the overlapped region 130 is considered, which is obtained when a position k on the K coordinate reaches the light receiving surface conjugate image center position 112*e*.

Hereinafter, the pattern 121 is discussed, but the same applies to the pattern 122.

Figure 10:
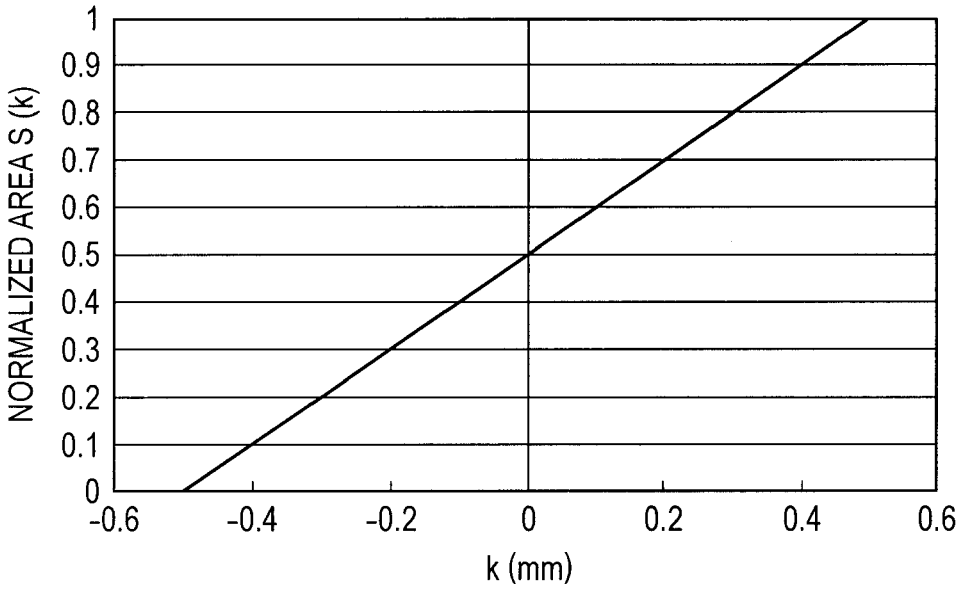
FIG. 10 illustrates a normalized detection signal in the non-parallel system located as designed.

FIG. 10 illustrates a detection signal obtained by assuming that the horizontal axis is the K coordinate and the vertical axis is the area S(k) of the overlapped region 130. Here, the area S(k) of the overlapped region 130 is normalized with a maximum value Smax of the overlapped region 130 being 1. When the area S(k) of the overlapped region 130 is at its maximum, the overlapped region 130 is equal to an overlapped region 132 (see FIG. 11) between the light emitting surface conjugate image 111 and the light receiving surface conjugate image 112.

In a normal state, the position k on the K coordinate that reaches the light receiving surface conjugate image center position 112*e* when the area S(k) of the overlapped region 130 satisfies:

$$S(k)=S\max/2 \quad (9),$$

is set as the detection position of the pattern. That is, when the area S(k) is Smax/2, the straight line portion of the pattern is regarded as having reached the light receiving surface conjugate image center position 112*e*.

In contrast, a position on the K coordinate, which is an intersection between the straight line portion of the pattern and the K-axis, is set as a real position. For the sake of the description, an origin point of the K-axis of a graph indicating the detection signal is set as the real position.

Figure 11:
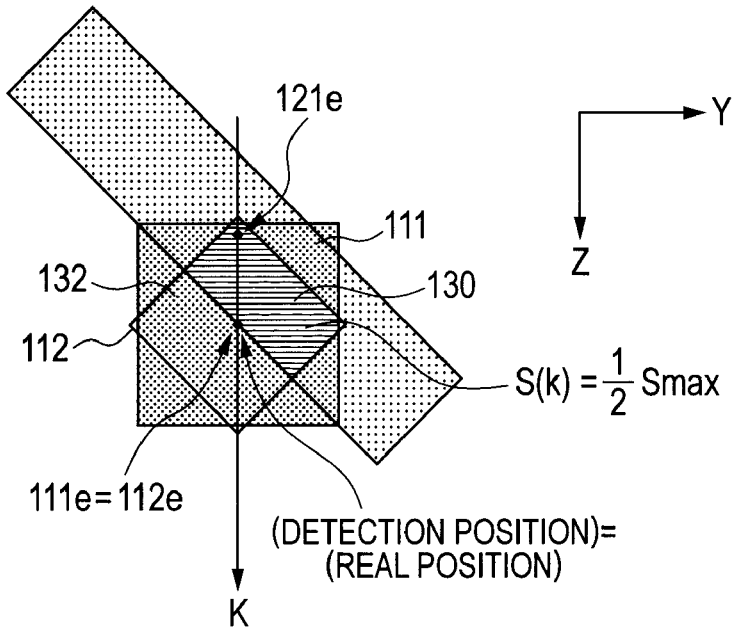
FIG. 11 is an explanatory diagram of the pattern 121 and an overlapped region 130 in a detection position of the non-parallel system located as designed.

As is clear from FIG. 11 illustrating the light emitting surface conjugate image 111, the light receiving surface conjugate image 112, and the pattern 121 in the detection position, the detection position coincides with the real position.

Figure 12:
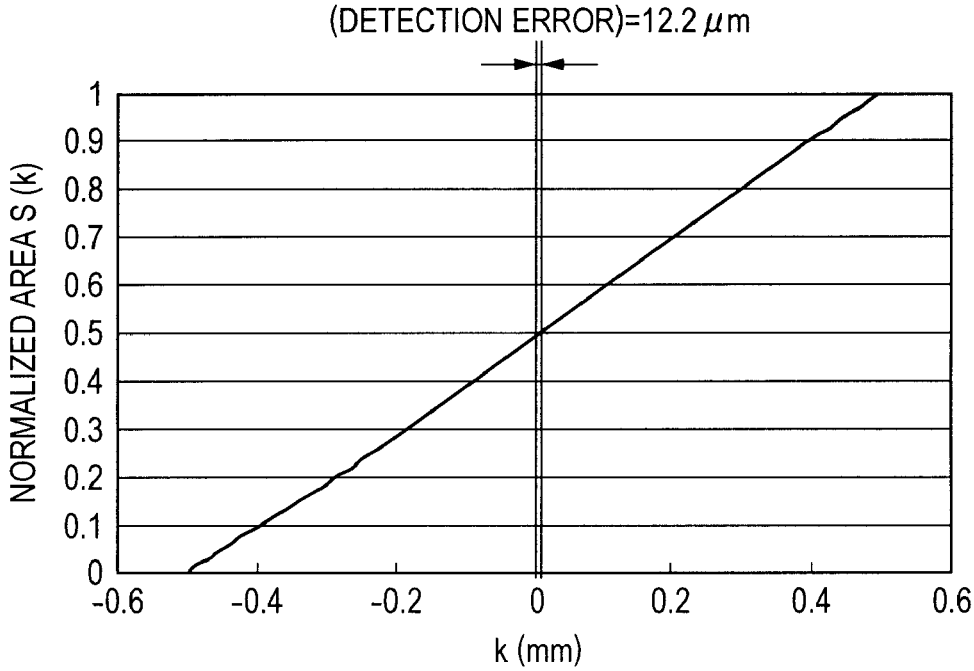
FIG. 12 illustrates the normalized detection signal in the non-parallel system having a positioning error.
Figure 13:
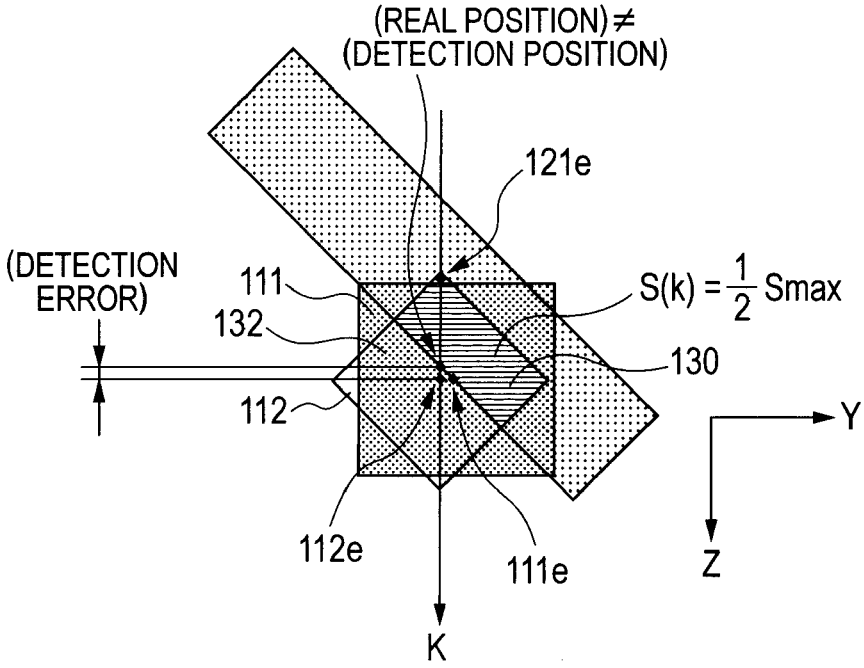
FIG. 13 is an explanatory diagram of the pattern 121 and the overlapped region 130 in the detection position of the non-parallel system having the positioning error.

Next, a case is considered where such a positioning error that the light source 31 is located in a position shifted by 0.1 mm in the main scanning direction (Y direction) occurs. FIG. 12 illustrates a normalized detection signal obtained in this case by assuming that the horizontal axis is the K coordinate and the vertical axis is the area S(k) of the overlapped region 130. Further, FIG. 13 illustrates the light emitting surface conjugate image 111, the light receiving surface conjugate image 112, and the pattern 121 in the detection position. The light receiving surface conjugate image center position 111*e* deviates due to the positioning error, and the shape of the overlapped region 132 is asymmetric in the main/sub scanning directions in terms of the light receiving surface conjugate image center position 112*e*.

In this case, because of the asymmetry, the position k on the K coordinate that reaches the light receiving surface conjugate image center position 112*e* when S(k)=Smax/2 is different from the position on the K coordinate which is the intersection between the straight line portion of the pattern 121 and the K-axis. That is, the detection position is different from the real position. As described above, if the overlapped region 132 is not symmetric in the main/sub scanning directions in terms of the light receiving surface conjugate image center position 112*e*, the detection position is different from the real position. A difference amount therebetween is defined as "detection error amount", and a position error amount in the main/sub scanning directions which occurs due to the detection error amount is defined as "detected position error amount".

The detected position error amount at this time is 12.2 μm in the Y direction and 0 μm in the Z direction. In the case of being located as designed, there is no detection error amount, and hence the above-mentioned amount is a change amount of the detected position error amount in the non-parallel system.

In other words, the detected position error amount represents detecting accuracy of the image information detecting apparatus. That the detected position error amount changes depending on the positioning error which is an error of the position at which the light source is disposed means that the detecting accuracy changes depending on the positioning error. That is, the change amount of the detected position error amount depending on the positioning error means stability of color misregistration correction performance due to an individual difference of the image information detecting apparatus or an environmental change.

An object of the present invention is to enhance the stability of performance for correcting a color misregistration due to the individual difference of the image information detecting apparatus or the environmental change.

Hereinafter, the first embodiment of the present invention is described.

As illustrated in FIG. 4, this embodiment has a feature that the angles θa1 and θa2 formed between the straight line portions 111*d* and 111*c* of the light emitting surface conjugate image 111 and the Z direction are 45° and 135°, respectively, and that a combination of straight line portions having a parallel relationship exists between the light emitting surface conjugate image 111 and the light receiving surface conjugate image 112. Such a system is defined as "parallel system". In this embodiment, the angle formed between the straight line portion 111*d* of the light emitting surface conjugate image 111 and the straight line portion 112*d* of the light receiving surface conjugate image 112 is 0°.

Figure 14:
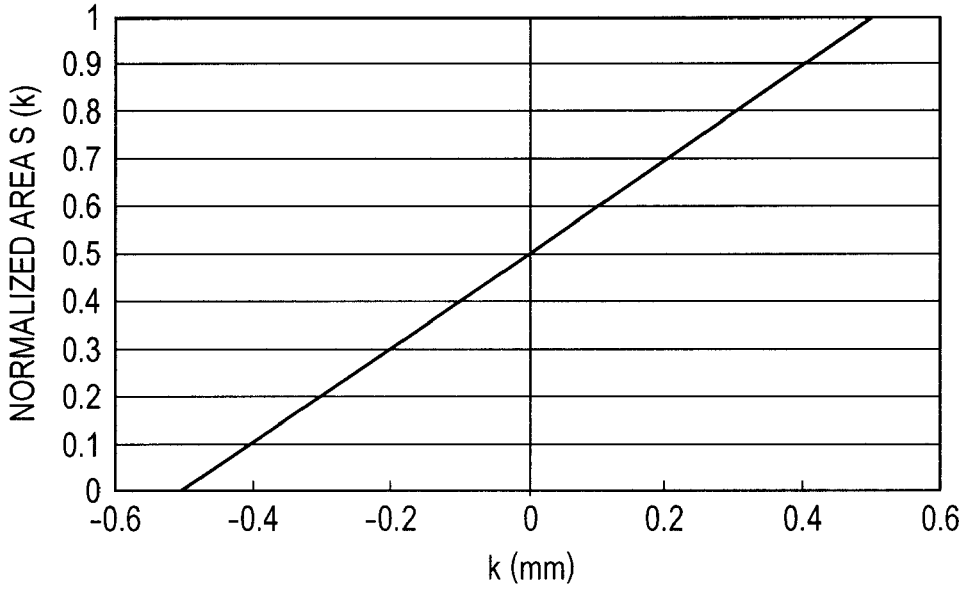
FIG. 14 illustrates a normalized detection signal in a parallel system located as designed according to the first embodiment of the present invention.
Figure 15:
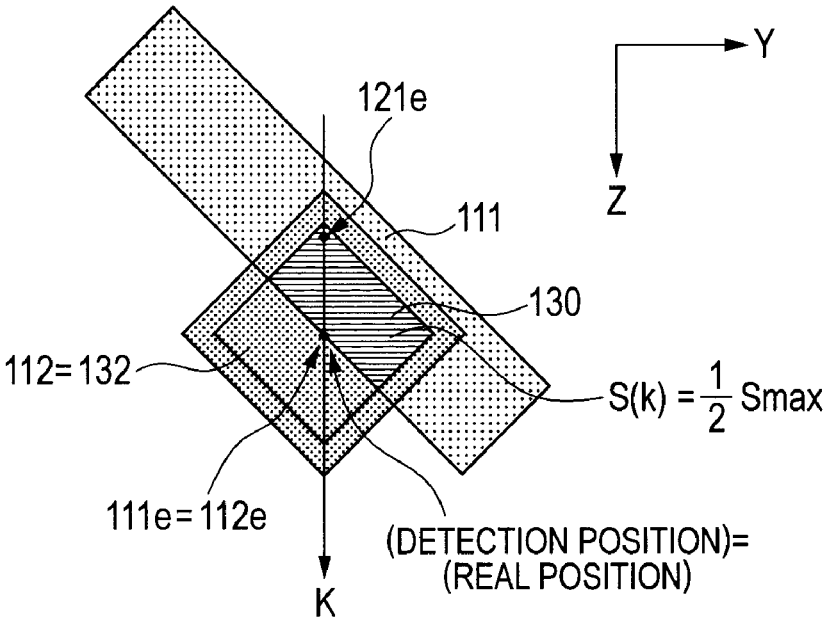
FIG. 15 is an explanatory diagram of the pattern 121 and the overlapped region 130 in a detection position of the parallel system located as designed according to the first embodiment of the present invention.

FIG. 14 illustrates the normalized detection signal obtained by assuming that the horizontal axis is the K coordinate and the vertical axis is the area S(k) of the overlapped region 130 in the same manner as the case of the non-parallel system. Further, FIG. 15 illustrates the light emitting surface conjugate image 111, the light receiving surface conjugate image 112, and the pattern 121 for detecting an overlap positional deviation, in the detection position. The shape of the overlapped region 132 is symmetric in the main/sub scanning directions in terms of the light receiving surface conjugate image center position 112*e*, and hence no detected position error amount occurs.

Next, in the same manner as the case of the non-parallel system, a case is considered where such a positioning error that the light source 31 is located in the position shifted by 0.1 mm in the main scanning direction (Y direction) occurs.

Figure 16:
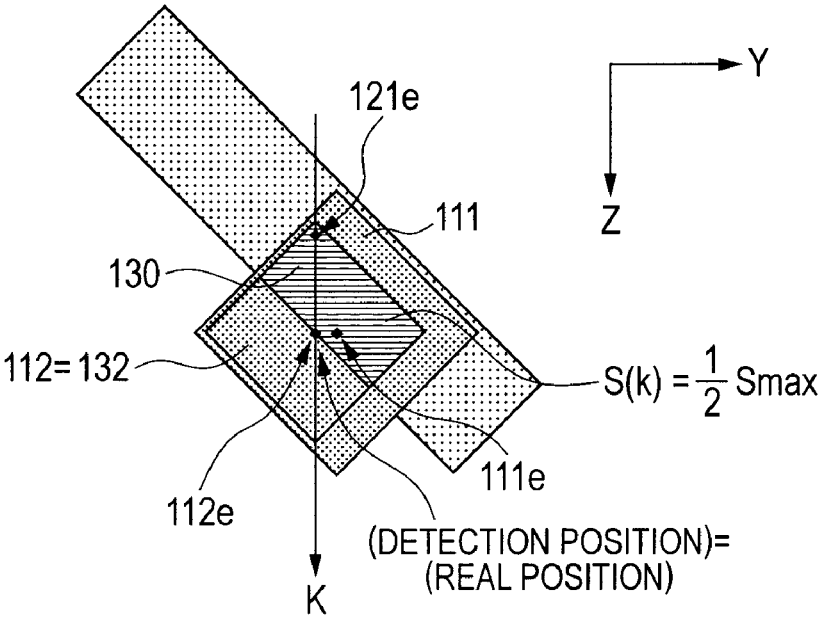
FIG. 16 is an explanatory diagram of the pattern 121 and the overlapped region 130 in the detection position of the parallel system having a positioning error according to the first embodiment of the present invention.

FIG. 16 illustrates the light emitting surface conjugate image 111, the light receiving surface conjugate image 112, and the pattern 121 in the detection position. As is clear from FIG. 16, in the parallel system, the overlapped region 132 does not change even if the light emitting surface conjugate image center position 111*e* deviates from the light receiving surface conjugate image center position 112*e* due to the positioning error. Therefore, the normalized detection signal is the same as in the case of being located as designed as illustrated in FIG. 14. With regard to the detected position error amount, no detected position error amount occurs in the same manner as in the case of being located as designed. Accordingly, in the parallel system, the detected position error amount does not change depending on the positioning error.

As described above, in the parallel system, the overlapped region 132 is hard to change geometrically even if the light emitting surface conjugate image center position 111*e* deviates from the light receiving surface conjugate image center position 112*e* due to the positioning error. Accordingly, there is little change in the detected position error amount depending on the positioning error, thereby producing an effect that the color misregistration correction performance regardless of the individual difference of the image information detecting apparatus or the environmental change is stabilized.

Here, based on the above discussion that the light receiving surface conjugate image 112 does not have a precise square shape, the overlapped region 132 is not symmetric precisely in the main/sub scanning directions in terms of the light receiving surface conjugate image center position 112*e*. Therefore, strictly speaking, a detected position error amount occurs in any case. However, this does not affect the advantageous effect of the present invention, and hence the description of the present invention given so far raises no problem.

Here, the principal ray of the illumination light is set to perpendicularly enter the transferring belt 34 in order to make the light emitting surface conjugate image 111 symmetric in the main scanning direction and the sub scanning direction in terms of the light emitting surface conjugate image center position 111*e* thereof. Therefore, when the light emitting surface conjugate image center position 111*e* is coincident with the light receiving surface conjugate image center position 112*e*, the overlapped region 132 is set as symmetric as possible in the main/sub scanning directions in terms of the light receiving surface conjugate image center position 112*e*. As a result, the detecting accuracy is improved.

In this embodiment, the pattern for detecting the overlap positional deviation has a rectangular shape in which a pair of opposing sides is parallel with each other.

Hereinafter, the effect is described with regard to the pattern 121 for detecting the overlap positional deviation, but the same applies to the pattern 122 for detecting the overlap positional deviation.

The straight line portions 121*b* and 121*d* are parallel with each other, and hence the detected position error amount of the detection signal obtained when the straight line portion 121*b* reaches the light receiving surface conjugate image center position 112*e* is logically equal to the detected position error amount of the detection signal obtained when the straight line portion 121*d* reaches the light receiving surface conjugate image center position 112*e*. That is, the same information on the detected position error amount can be obtained at the rising edge and the falling edge of the detection signal. By performing detection twice at the rising edge and the falling edge of the detection signal and averaging the detection positions, it is possible to reduce the influence of the noise present in the signal and to improve the detecting accuracy. The case is described above where the light receiving surface conjugate image 112 is smaller than the light emitting surface conjugate image 111, but the same applies to a case where the light emitting surface conjugate image 111 is smaller than the light receiving surface conjugate image 112.

Figure 17:
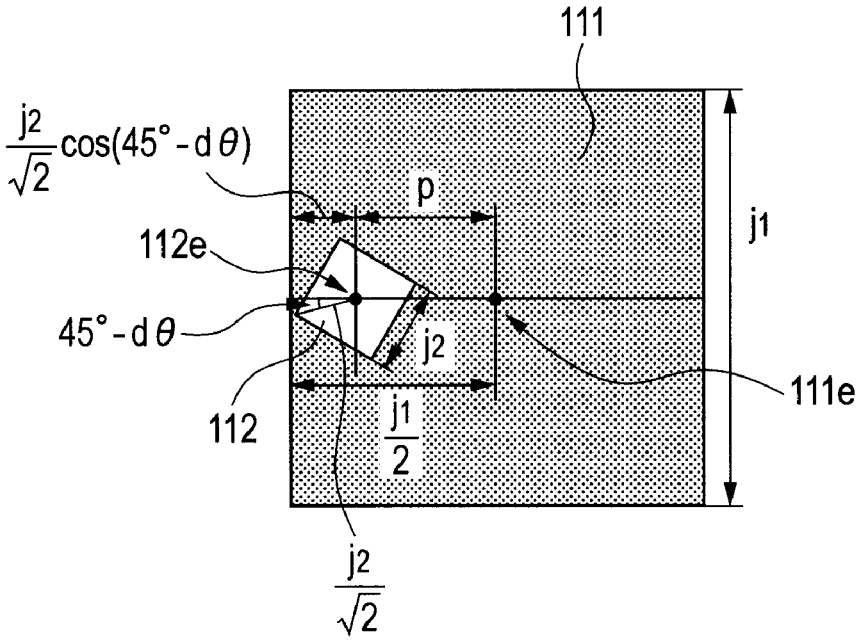
FIG. 17 is an explanatory diagram of a definition of being substantially parallel that makes the present invention effective according to the first embodiment of the present invention.

Here, the phrase "substantially parallel" discussed so far is defined with reference to FIG. 17. In many cases, the light emitting surface conjugate image 111 and the light receiving surface conjugate image 112 are square, and the light emitting surface conjugate image center position 111*e* and the light receiving surface conjugate image center position 112*e* are coincident with each other in the case of being located as designed.

The length of one side of the light emitting surface conjugate image 111 is set as $j_1$, the length of one side of the light receiving surface conjugate image 112 is set as $j_2$, and an angle formed between the straight line portions of the light emitting surface conjugate image 111 and the light receiving surface conjugate image 112 is set as $d\theta$ ($\theta° \leqq d\theta < 45°$). A case is described below where $j_2 < j_1$, but the same applies to a case where $j_1 < j_2$.

If the following expression is satisfied, the shape of the overlapped region 132 coincides with the shape of the light receiving surface conjugate image 112 in the case of being located as designed:

$$\frac{j_2}{\sqrt{2}}\cos(45° - d\theta) \leq \frac{j_1}{2} \tag{10}$$

Unless at least this condition is satisfied in the location at the time of designing, the symmetry of the overlapped region 132 in terms of the light receiving surface conjugate image center position 112*e* changes when the light source or the light receiving element is located in a position shifted from a predetermined position (when the light source or the light receiving element exhibits a positioning error). Therefore, if there is a positioning error, the above-mentioned detected positional deviation amount occurs.

Therefore, in the first embodiment of the present invention, the phrase "substantially parallel" is defined at least that the shape of the overlapped region 132 coincides with the shape of the light receiving surface conjugate image 112 in the case of being located as designed.

When $j_2 = j_1$, the substantially parallel relationship is not established unless the angle $d\theta$ formed between the straight line portions of the light emitting surface conjugate image 111 and the light receiving surface conjugate image 112 is 0. Therefore, if a difference between the length $j_1$ of one side of the light emitting surface conjugate image 111 and the length $j_2$ of one side of the light receiving surface conjugate image 112 is small, the angle $d\theta$ formed between the straight line portions of the light emitting surface conjugate image 111 and the light receiving surface conjugate image 112 which are substantially parallel with each other has a small range and the angle $d\theta$ s sensitive to the positioning error of the light source or the light receiving element.

Therefore, in order not to be sensitive to the positioning error, in a normal case, sizes of the light emitting surface conjugate image 111 and the light receiving surface conjugate image 112 are adjusted to such an extent as to satisfy at least the following expression:

$$1.2 \leq \frac{j_1}{j_2} \tag{11}$$

Based on the relationship illustrated in FIG. 17 between the light emitting surface conjugate image 111 and the light receiving surface conjugate image 112 and the above-mentioned definition expression for the substantially parallel relationship, the condition of the angle $d\theta$ for establishing the substantially parallel relationship when $1.2 \times j_2 = j_1$, in which the sensitivity to the positioning error is liable to be highest in the above-mentioned range, can be obtained as follows:

$$\begin{aligned} &\frac{j_2}{\sqrt{2}}\cos(45° - d\theta) \leq \frac{j_1}{2} \\ &\cos(45° - d\theta) \leq \frac{1}{\sqrt{2}}\frac{j_1}{j_2} \\ &\cos(45° - d\theta) \leq 0.849 \end{aligned} \tag{12}$$

In Expressions (12), the horizontal direction illustrated in FIG. 17 is considered, but the same relationship needs to be established with respect to the vertical direction, the following expressions can be obtained:

$$\begin{aligned} &\frac{j_2}{\sqrt{2}}\sin(45° - d\theta) \leq \frac{j_1}{2} \\ &\sin(45° - d\theta) \leq \frac{1}{\sqrt{2}}\frac{j_1}{j_2} \\ &\sin(45° - d\theta) \leq 0.849 \end{aligned} \tag{13}$$

Here, the light emitting surface conjugate image 111 and the light receiving surface conjugate image 112 are both square and four-fold symmetric, and hence the difference in the angle dθ formed between the corresponding straight line portions of the light emitting surface conjugate image 111 and the light receiving surface conjugate image 112 has a range from −45° to +45°, thereby satisfying the following expressions:

$$-13.1° \leqq d\theta \leqq 13.1° \tag{14}$$

$$|d\theta| \leqq 13.1° \tag{15}$$

Therefore, $|d\theta| \leqq 13°$ is defined as the substantially parallel relationship under the condition that $1.2 \times j_2 = j_1$. In other words, it is defined that the substantially parallel relationship is established when there exists at least one combination of the angles θa and θb which satisfy $|\theta a - \theta b| \leqq 13°$ on the assumption that the angle θa is formed between one straight line portion defining the contour of the light emitting surface conjugate image 111 and a moving direction of the image bearing member and that the angle θb is formed between one straight line portion defining the contour of the light receiving surface conjugate image 112 and the moving direction. As long as the above-mentioned relationship expression is satisfied, even if a positioning error occurs, the overlapped region 132 is hard to change, which stabilizes the detecting accuracy. If the above-mentioned relationship is not satisfied, the effect of the present invention cannot be obtained to a sufficient extent.

Next described are the sizes of the light emitting surface conjugate image 111 and the light receiving surface conjugate image 112 which are suitable for producing the effect of the present invention.

In many cases, the light emitting surface conjugate image 111 and the light receiving surface conjugate image 112 are both square, and the light emitting surface conjugate image 111 is larger than the light receiving surface conjugate image 112. Note that, the case is described below where the light emitting surface conjugate image 111 is larger than the light receiving surface conjugate image 112 ($j_2 < j_1$), but the same applies to the case where the light emitting surface conjugate image 111 is smaller than the light receiving surface conjugate image 112 ($j_1 < j_2$).

It is ideal that the light emitting surface conjugate image center position 111*e* and the light receiving surface conjugate image center position 112*e* are coincident with each other in the case of being located as designed. Due to the positioning error, a relative positional deviation amount p occurs between the light emitting surface conjugate image center position 111*e* and the light receiving surface conjugate image center position 112*e*. If the overlapped region 132 in the parallel system is equal to the overlapped region 132 in the non-parallel system when a positioning error occurs, the effect of the present invention cannot be obtained. That is, if the light emitting surface conjugate image 111 is sufficiently larger than the light receiving surface conjugate image 112, both the parallel system and the non-parallel system are sufficiently strong against the positioning error, which hardly produces the effect of the present invention. From this viewpoint, an effective range of the present invention is defined.

Figure 18:
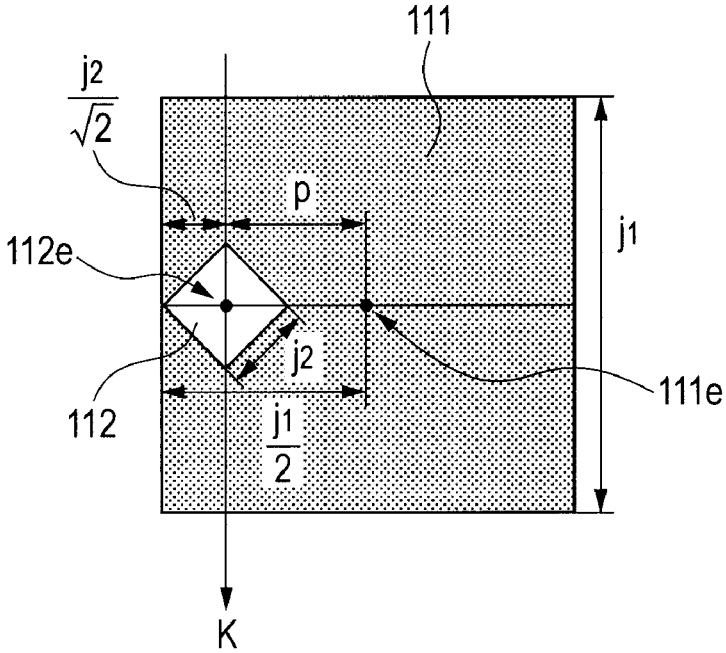
FIG. 18 is an explanatory diagram of an optical magnification that makes the present invention effective according to the first embodiment of the present invention.

As an example of criticality in which the effect of the present invention cannot be obtained, FIG. 18 illustrates the light emitting surface conjugate image 111 and the light receiving surface conjugate image 112 in a case of the relative positional deviation amount p immediately before the shape of the overlapped region 132 does not coincide with the shape of the light receiving surface conjugate image 112 in the non-parallel system. As can be understood from FIG. 18, in order to obtain the effect of the present invention, the following expression needs to be satisfied:

$$\frac{j_1}{2} < p + \frac{j_2}{\sqrt{2}} \tag{16}$$

If the above-mentioned expression is not satisfied, both the parallel system and the non-parallel system are insensitive to the positioning error because the shape of the overlapped region 132 coincides with the shape of the light receiving surface conjugate image 112, which hardly produces the effect of the present invention. In a normal case, the length $j_2$ of one side of the light receiving surface conjugate image 112 is adjusted so that the position detecting accuracy is not sensitive to the positioning error, and hence it is hard to imagine that the relative positional deviation amount p due to the positioning error is larger than $j_2/2$. Therefore, the effect of the present invention can be obtained within a range that satisfies the following expression:

$$\frac{j_1}{2} < \left(1 + \frac{1}{\sqrt{2}}\right)\frac{j_2}{2} \tag{17}$$

The lengths $j_1$ and $j_2$ are expressed by using the length $q_1$ of one side of the light emitting surface, the length $q_2$ of one side of the light receiving surface, and the optical magnifications $\beta_1$ and $\beta_2$, as follows:

$$j_1 = |\beta_1| \times q_1 \tag{18}$$

$$j_2 = \frac{1}{|\beta_2|} \times q_2 \tag{19}$$

Based on the above-mentioned expressions, the following expressions are set as a boundary for maintaining the present invention effective:

$$|\beta_1| \times q_1 < 1.7 \times \frac{q_2}{|\beta_2|} \tag{20}$$

If the above-mentioned expression is not satisfied, the effect of the present invention is small.

As described above, the system according to this embodiment is located in such a manner that the straight line portion of the light emitting surface conjugate image and the straight line portion of the light receiving surface conjugate image have a substantially parallel relationship. This stabilizes the detecting accuracy with regard to the positioning error.

Further, the system according to this embodiment is configured such that the principal ray of the illumination light perpendicularly enters the image bearing member, located so as to satisfy Expression (20), and set to have the pattern having a rectangular shape in which a pair of opposing sides is parallel with each other. Accordingly, it is possible to reduce the noise and improve the detecting accuracy.

Further, the boundary for maintaining the present invention effective other than Expression (20) is described. If the length $j_1$ of one side of the light emitting surface conjugate image 111 and the length $j_2$ of one side of the light receiving surface conjugate image 112 are expressed by using the length $q_1$ of one side of the light emitting surface, the length $q_2$ of one side of the light receiving surface, and the optical magnifications $\beta_1$ and $\beta_2$, Expression (11) can be rewritten as follows:

$$1.2 \leq \frac{j_1}{j_2} = \frac{|\beta_1| \times |\beta_2| \times q_1}{q_2} \quad (21)$$

If Expression (21) is not satisfied, the angle dθ formed between the straight line portions of the light emitting surface conjugate image 111 and the light receiving surface conjugate image 112 which are substantially parallel with each other has a small range. That is, even the nominal parallel system is sufficiently sensitive to the positioning error, and hence the effect of the present invention is small. Therefore, the establishment of Expression (21) is set as the boundary for maintaining the present invention effective.

Here, the case of satisfying Expression (21) has been described so far, but the present invention is not limited thereto. Note that, completely the same effect can be obtained even in a case of satisfying the following expression:

$$1.2 \leq \frac{j_2}{j_1} = \frac{q_2}{|\beta_1| \times |\beta_2| \times q_1} \quad (22)$$

Second Embodiment

As a second embodiment of the present invention, a case is considered where the angle θa1 formed between the straight line portion 111*d* of the light emitting surface conjugate image 111 and the Z direction is 35° and the angle θb1 formed between the straight line portion 112*d* of the light receiving surface conjugate image 112 and the Z direction is 45°, that is, the angle dθ formed between the straight line portion 111*d* of the light emitting surface conjugate image 111 and the straight line portion 112*d* of the light receiving surface conjugate image 112 is 10°. The other parts of configuration are the same as those of the first embodiment.

Hereinafter, the pattern 121 for detecting the overlap positional deviation is discussed in the same manner as the first embodiment, but the same applies to the pattern 122 for detecting the overlap positional deviation.

Figure 19:
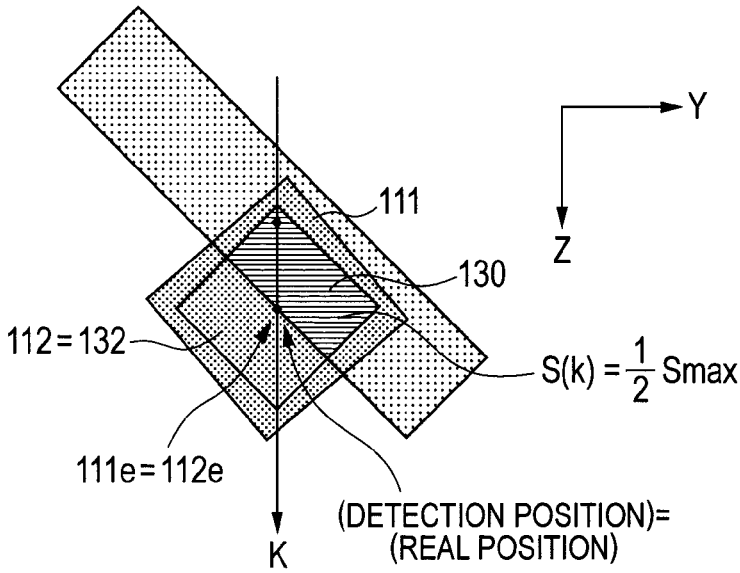
FIG. 19 is an explanatory diagram of the pattern 121 and the overlapped region 130 in the detection position of the parallel system with θa1=35° which is located as designed according to a second embodiment of the present invention.

FIG. 19 illustrates the light emitting surface conjugate image 111, the light receiving surface conjugate image 112, and the pattern 121 for detecting the overlap positional deviation, in the detection position. The normalized detection signal obtained in this case is the same as that illustrated in FIG. 14.

Figure 20:
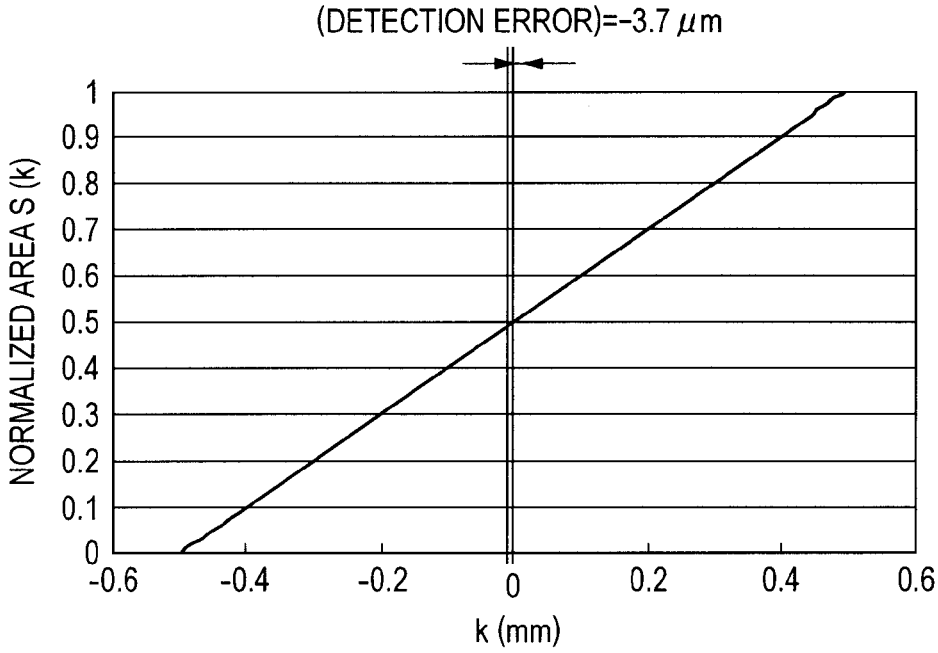
FIG. 20 illustrates the normalized detection signal in the parallel system with θa1=35° which has the positioning error according to the second embodiment of the present invention.
Figure 21:
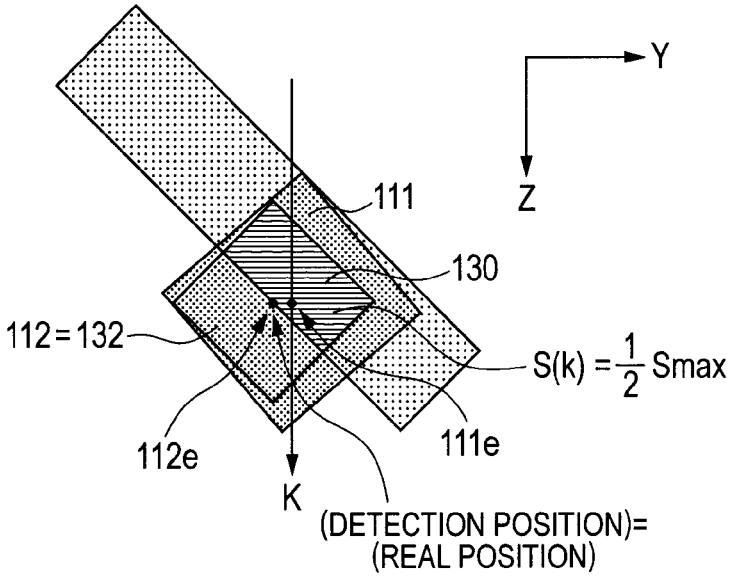
FIG. 21 is an explanatory diagram of the pattern 121 and the overlapped region 130 in the detection position of the parallel system with θa1=35° which has a positioning error according to the second embodiment of the present invention.

In the same manner as the first embodiment, with regard to the positioning error, a case is considered where the light source 31 is located in the position shifted by 0.1 mm in the main scanning direction. FIG. 20 illustrates the normalized detection signal obtained by assuming that the horizontal axis is the K coordinate and the vertical axis is the area S(k) of the overlapped region 130. FIG. 21 illustrates the light emitting surface conjugate image 111, the light receiving surface conjugate image 112, and the pattern 121 in the detection position. The detected position error amount obtained from this case is 4.2 μm in the Y direction and 0.5 μm in the Z direction. In the case of being located as designed, the detection error amount is 0 μm, and hence the above-mentioned amount is the change amount of the detected position error amount.

In comparison with the non-parallel system described in the first embodiment, the change amount of the detected position error amount is smaller. Thus, even if a positioning error occurs, as the system is configured closer to the parallel system, a change in the overlapped region 132 becomes smaller and the change amount of the detected position error amount becomes smaller, thereby stabilizing the detecting accuracy.

As is clear therefrom, the effect of the present invention can be obtained even if the angle dθ formed between the straight line portion 111*d* of the light emitting surface conjugate image 111 and the straight line portion 112*d* of the light receiving surface conjugate image 112 is 10°.

As illustrated in FIG. 5, the system according to this embodiment is configured such that the angles θc1 and θc2 formed between the straight line portions 121*b* and 122*c* of the patterns and the Z direction (transport direction of the transferring belt 34 or moving direction of the image bearing member) are 45° and 135°, respectively, and that a combination of straight line portions having a parallel relationship exists between the light emitting surface conjugate image 111 and the light receiving surface conjugate image 112. This is the same as the first embodiment. Such a system is defined as "pattern parallel system".

It has been described so far that the area of the overlapped region 132 is harder to change depending on the positioning error as the system is configured closer to the parallel system, with the result that the overlapped region 130 is harder to change, and hence the detected position error amount due to the positioning error is harder to change.

Even in the pattern parallel system, based on the same discussion as the parallel system, as the system is configured closer to the pattern parallel system, the overlapped region 130 is harder to change, and hence the detected position error amount due to the positioning error is harder to change. Therefore, even if a positioning error occurs in the location designed as in this embodiment to such an extent that a change occurs in the detected position error amount, the change in the detected position error amount depending on the positioning error is small, thereby stabilizing the detecting accuracy.

Accordingly, in consideration of a production error, such a configuration that the angles θc1 and θc2 formed between the straight line portions 121*b* and 122*c* of the patterns and the Z direction are 45°±5° and 135°±5°, respectively, that is, such a configuration as to satisfy the following expression:

$$40° \leqq \theta c1 \leqq 50°,\ 130° \leqq \theta c \leqq 140° \quad (23)$$

is desired to obtain the effect of the present invention.

Third Embodiment

As a third embodiment of the present invention, an image information detecting apparatus that receives normal reflected light is described.

Figure 22:
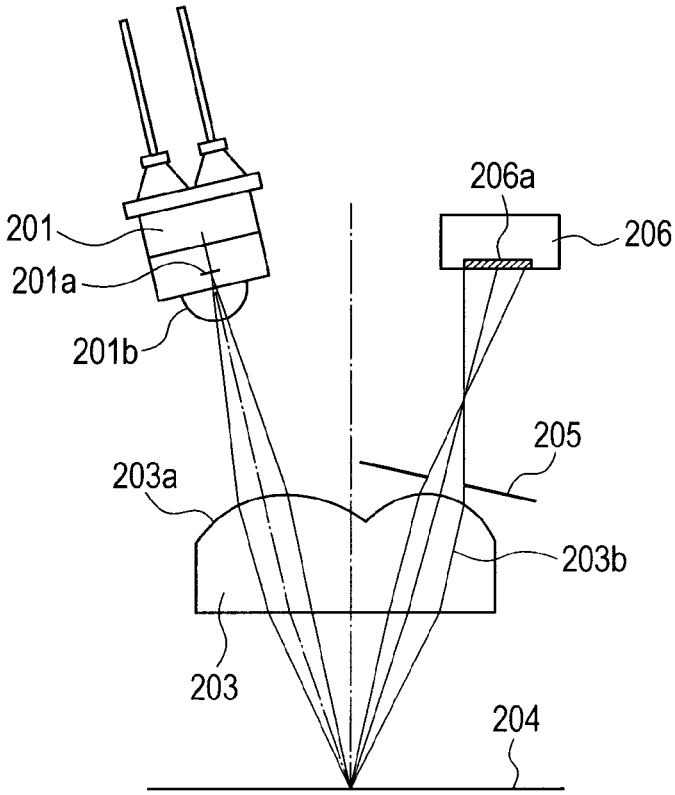
FIG. 22 is a schematic diagram of a main portion of an image information detecting apparatus according to a third embodiment of the present invention.

FIG. 22 is a sub-scanning sectional view of a main portion of the image information detecting apparatus according to the third embodiment. With reference to FIG. 22, a configuration of the image information detecting apparatus is described.

The image information detecting apparatus includes the illumination unit, the illumination optical system, the transferring belt, the light receiving optical system, and the light receiving unit.

The illumination unit includes an LED light source 201. A shape of a light emitting surface 201*a* of the LED light source 201 is a square of 0.35 mm on one side. A beam emitted from the light emitting surface 201*a* is condensed at a condensing part 201*b*. An optical element 203 is an optical element which is integrally formed by an illumination lens 203*a* serving as the illumination optical system and an imaging lens 203*b* serving as the light receiving optical system both of which are made of the same material. The pattern for position detection made of toner is caused to move in the Z direction by a transferring belt 204 serving as the image bearing member. The light receiving optical system includes the imaging lens 203*b* and a stop 205 for limiting the beam emitted from the imaging lens 203*b*. A shape of a light receiving surface 206*a* of a light receiving element 206 serving as the light receiving unit is a square of 1 mm on one side.

In FIG. 22, a direction perpendicular to the surface of the transferring belt 204 is set as the X direction, a direction parallel to the drawing sheet and perpendicular to the X direction is set as the Y direction, and a direction perpendicular to the drawing sheet is set as the Z direction. The Y direction is a main scanning direction of the image forming apparatus, and the Z direction is the sub scanning direction of the image forming apparatus. The Z direction is the transport direction of the transferring belt which is a direction along which the pattern for position detection moves.

The beam emitted from the light source 201 illuminates a surface of the transferring belt 204 via the illumination lens 203*a*. A part of light scattered by the pattern formed on the transferring belt 204 is condensed by the imaging lens 203*b*, and the beam is limited by the stop 205 and received by the light receiving element 206.

In order to increase the received light quantity, in the illumination optical system, the light emitting surface 201*a* and the surface of the transferring belt 204 are caused to have a substantially optical conjugate relationship by the condensing part 201*b* and the illumination lens 203*a*. A magnification $\beta_3$ of the illumination optical system is defined by assuming that the light emitting surface 201*a* is the object point and that the surface of the transferring belt 204 (surface of the image bearing member) is the image plane. In this embodiment, $\beta_3=-2.6$.

A light emitting surface conjugate image 211 being a substantially conjugate image of the light emitting surface 201*a* is projected onto the surface of the transferring belt 204. A principal ray of the beam emitted from the light source 201 enters the surface of the transferring belt 204 at an incident angle of 25°. Therefore, the light emitting surface 201*a* is square, but the light emitting surface conjugate image 211 exhibiting different magnifications in the main scanning direction within its region does not have a precise square shape but has a distorted shape.

For the same purpose as the illumination optical system, also in the light receiving optical system, the surface of the transferring belt 204 and the light receiving surface 206*a* are caused to have a substantially optical conjugate relationship by the imaging lens 203*b*. A magnification $\beta_4$ of the light receiving optical system is defined by assuming that the surface of the transferring belt 204 (surface of the image bearing member) is the object point and that the light receiving surface 206*a* is the image plane. In this embodiment, $\beta_4=-1.4$.

In the same manner as the first embodiment, a light receiving surface conjugate image is considered, which is a substantially conjugate image obtained by assuming that the light receiving surface 206*a* is the object point and that the surface of the transferring belt 204 is the image plane. The light receiving element 206 receives scattered light from the region of the light receiving surface conjugate image.

The light receiving optical system according to this embodiment is located with an angle of 25° with respect to the perpendicular direction (−X direction) of the surface of the transferring belt 204. Therefore, the light receiving surface conjugate image exhibiting different magnifications in the main scanning direction within its region does not have a precise square shape but has a distorted shape.

However, the distorted shapes of the light emitting surface conjugate image and the light receiving surface conjugate image do not cause a problem in the description of the effect of the present invention. This embodiment of the present invention is beneficial as discussed in the first embodiment, and hence description thereof is omitted.

According to the first to third embodiments, the light emitting surfaces of the light sources and the light receiving surfaces of the light receiving unit all have a square shape, but the present invention is not limited to the square shape.

In the first to third embodiments, the shapes of the light emitting surfaces of the light sources and the light receiving surfaces of the light receiving unit may all have a rectangular shape.

Further, in the first to third embodiments, the shapes of the light emitting surfaces of the light sources and the light receiving surfaces of the light receiving unit may all have an oblong shape such as a trapezoid or a rhombus that is a quadrangular shape.

Fourth Embodiment

Described below is an image forming apparatus including the image information detecting apparatus discussed so far.

Figure 23:
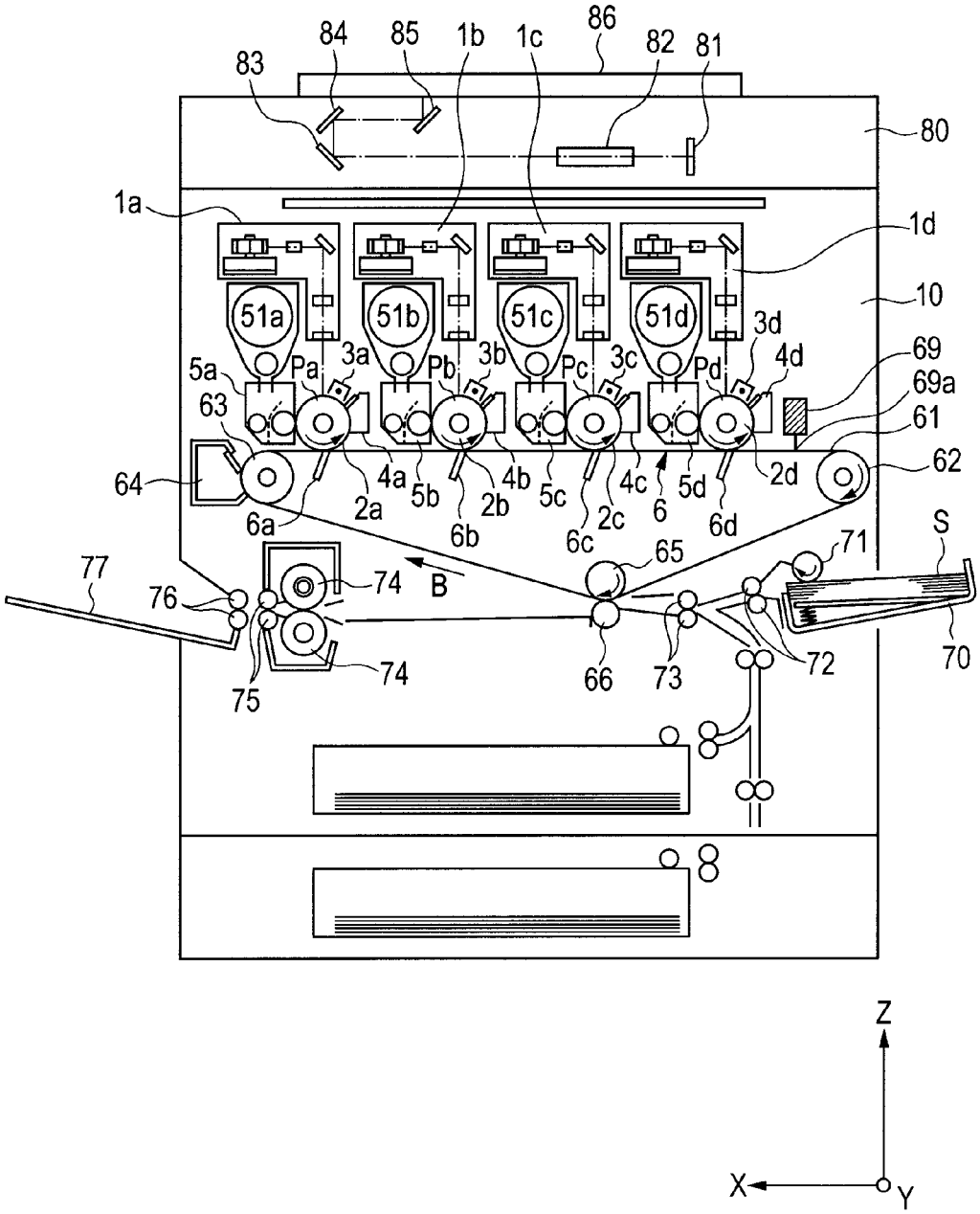
FIG. 23 is a schematic diagram of a main portion of an image forming apparatus according to the fourth embodiment including the image information detecting apparatus according to an embodiment of the present invention.

FIG. 23 is a schematic diagram of a main portion of the image forming apparatus including the image information detecting apparatus according to an embodiment of the present invention, which is applied to a digital full color copier.

First, a construction and an operation of the digital full color copier of FIG. 23 are described.

In an original reader section 80, image information on a color image placed on an original glass table 86 is read by forming an image on a surface of a reading unit 81 of a CCD or the like by using mirrors 83, 84, and 85 and a reading lens 82. The color image information obtained from the reading unit 81 is input to a full color image forming section 10.

In the full color image forming section 10, four (first to fourth) image forming stations (image forming sections (image forming units) Pa to Pd) are arranged. The respective image forming stations (Pa to Pd) include photosensitive drums (2*a* to 2*d*) serving as image bearing members. Further, respectively arranged around the photosensitive drums (2*a* to 2*d*) are dedicated charging units (3*a* to 3*d*), scanning optical devices (1*a* to 1*d*) for illuminating the surface of the photosensitive drum with a beam corresponding to image information, developing units (5*a* to 5*d*), drum cleaning units (4*a* to 4*d*), and transferring units (6*a* to 6*d*).

Developer containers 51*a* to 51*d* corresponding to the respective developing units (5*a* to 5*d*) are provided immediately under horizontal portions of the scanning optical devices (1*a* to 1*d*) and in alignment with vertical portions thereof. The developer containers 51*a* to 51*d* perform replenishment of developers by attaching and detaching developer cartridges having a cylindrical shape. Here, the image forming stations (Pa to Pd) form a cyan image, a magenta image, a yellow image, and a black image, respectively.

Meanwhile, a transferring belt (recording member) having an endless belt shape is disposed below the photosensitive drums (2*a* to 2*d*) in such manner as to pass the respective image forming stations (Pa to Pd). The transferring belt 61 is stretched around a drive roller 62 and driven roller 63 and 65, and a cleaning unit 64 for cleaning a front surface thereof is also provided.

The scanning optical devices (1*a* to 1*d*) each include: a semiconductor laser serving as a light source unit; an incident optical unit for introducing a beam emitted from the semiconductor laser to a polygon mirror; an imaging unit including a toric lens and optical elements such as a spherical lens and an aspherical lens, for causing a beam deflected by the polygon mirror to image on the surface of the corresponding one of the photosensitive drums (2*a* to 2*d*) serving as the image bearing members; a reflecting mirror serving as a reflecting member provided between the toric lens and the optical elements; and a enclosing unit for integrally enclosing those optical elements.

In such a construction, first, a latent image of a cyan component corresponding to image information is formed on the surface of the photosensitive drum 2*a* by known electrophotographic process means in the first image forming station Pa such as the charging unit 3*a* and exposure performed by the scanning optical device 1*a*. After that, the latent image is visualized as a cyan pattern by the developing unit 5*a* with the developer having cyan toner, and the cyan pattern is transferred onto the front surface of the transferring belt 61 by the transferring unit 6*a*.

While the above-mentioned cyan pattern is transferred onto the transferring belt 61, in the second image forming station Pb, a latent image of a magenta component is formed, a pattern using magenta toner is subsequently obtained by the developing unit 5*b*, and the magenta pattern is transferred onto the transferring belt 61 on which the transfer has already been finished in the first image forming station Pa and is accurately overlapped on the cyan pattern.

After that, the image formation is performed on the yellow image and the black image by the same method. After the patterns of the four colors have been overlaid one on another on the transferring belt 61, a four-color pattern on the transferring belt 61 is again transferred (secondarily transferred) onto a sheet material S by a secondary transfer roller 66. The sheet material S is timely transported from a sheet feeding cassette 70 by a sheet feeding roller 71, a transport roller pair 72, and a registration roller pair 73. Then, the pattern transferred by a fixing roller pair 74 is heat-fixed on the sheet material S that has been subjected to the secondary transfer, and a full color image is obtained on the sheet material S. Then, the sheet material S on which the full color image has been formed is sent to a tray 77 via rollers 75 and 76.

Note that, the respective photosensitive drums in which the transfer has been finished (2*a* to 2*d*) have the cleaning units (4*a* to 4*d*) remove residual toner from the respective photosensitive drums (2*a* to 2*d*), and are prepared for subsequent image formation.

When facing FIG. 23, image information detecting apparatuses 69 having the same configuration are disposed in three positions at the back, the center, and the front of the transferring belt 61 or in two positions at the back and the front thereof.

Note that, the surface of the transferring belt 61 is in a state close to a mirror surface.

In this embodiment, before the image forming process is performed, the respective image forming sections Pa, Pb, Pc, and Pd form patterns for position detection 69*a* on the transferring belt 61 as four images corresponding to the image forming sections Pa, Pb, Pc, and Pd, respectively. That is, the four images are respectively formed as a whole. For the sake of simplicity, the patterns for position detection on the left and right are handled as one. Before executing the above-mentioned process at the image forming sections, the image information detecting apparatus 69 detects position information on the patterns for position detection 69*a* of images that have been formed in a non-image forming region of the respective photosensitive drums 2*a* to 2*d* and transferred onto the transferring belt 61 in its transport direction. Based on detection signals detected therefrom, the respective image forming sections Pa, Pb, Pc, and Pd are controlled by a control section.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-289223, filed Dec. 21, 2009 and Japanese Patent Application No. 2010-237093, filed Oct. 22, 2010 which are hereby incorporated by reference herein in their entirety.

What is claimed is:

1. An image information detecting apparatus for detecting an overlap positional deviation of images in a color image forming apparatus comprising multiple photosensitive drums, the image information detecting apparatus comprising:

a light source comprising a light emitting surface having a quadrangular shape;

an image bearing member that moves in a predetermined direction;

a light receiving unit comprising a light receiving surface having a quadrangular shape;

an illumination optical system for causing the light emitting surface of the light source and the image bearing member to have a conjugate relationship and illuminating a pattern for detecting the overlap positional deviation, which is formed on the image bearing member, with a beam emitted from the light source; and a light receiving optical system for causing the image bearing member and the light receiving surface of the light receiving unit to have a conjugate relationship and guiding the beam reflected by the pattern for detecting the overlap positional deviation to the light receiving unit, wherein a straight line portion of a conjugate image of the light emitting surface on the image bearing member which defines a contour of the conjugate image of the light emitting surface, and a straight line portion of a conjugate image of the light receiving surface on the image bearing member which defines a contour of the conjugate image of the light receiving surface, are parallel with each other.

2. An image information detecting apparatus according to claim 1, wherein:

the light emitting surface has a shape of a square, each side of which has a length of $q_1$;

the light receiving surface has a shape of a square, each side of which has a length of $q_2$; and the following expression is satisfied:

$$|\beta_1| \times q_1 < 1.7 \times \frac{q_2}{|\beta_2|}$$

where $\beta_1$ represents an optical magnification of the illumination optical system on an assumption that the light emitting surface is an object point and that a surface of the image bearing member is an image plane, and $\beta_2$ represents an optical magnification of the light receiving optical system on an assumption that the surface of the image bearing member is an object point and that the light receiving surface is an image plane.

3. An image information detecting apparatus according to claim 2, wherein one of the following expressions is satisfied:

$$1.2 \leq \frac{|\beta_1| \times |\beta_2| \times q_1}{q_2}$$

and

-continued $$1.2 \leq \frac{q_2}{|\beta_1| \times |\beta_2| \times q_1}.$$

4. An image information detecting apparatus according to claim 1, wherein a principal ray of the beam emitted from the light source perpendicularly enters the image bearing member.

5. A color image forming apparatus, comprising:

the image information detecting apparatus according to claim 1; and multiple photosensitive drums.

6. An image information detecting apparatus for detecting an overlap positional deviation of images in a color image forming apparatus comprising multiple photosensitive drums, the image information detecting apparatus comprising:

a light source comprising a light emitting surface having a quadrangular shape;

an image bearing member that moves in a predetermined direction;

a light receiving unit comprising a light receiving surface having a quadrangular shape;

an illumination optical system for causing the light emitting surface of the light source and the image bearing member to have a conjugate relationship and illuminating a pattern for detecting the overlap positional deviation, which is formed on the image bearing member, with a beam emitted from the light source; and a light receiving optical system for causing the image bearing member and the light receiving surface of the light receiving unit to have a conjugate relationship and guiding the beam reflected by the pattern for detecting the overlap positional deviation to the light receiving unit, wherein the following expression is satisfied:

$$|\theta a - \theta b| \leqq 13°$$

where θa represents an angle formed between a moving direction of the image bearing member and a straight line portion of a conjugate image of the light emitting surface which defines a contour of the conjugate image of the light emitting surface on the image bearing member, and θb represents an angle formed between the moving direction of the image bearing member and a straight line portion of a conjugate image of the light receiving surface which defines a contour of a conjugate image of the light receiving surface on the image bearing member.

7. An image information detecting apparatus according to claim 6, wherein a principal ray of the beam emitted from the light source perpendicularly enters the image bearing member.

8. An image information detecting apparatus according to claim 6, wherein the light emitting surface and the light receiving surface have one of a rectangular shape and a square shape.

9. An image information detecting apparatus according to claim 6, wherein:

the light emitting surface has a shape of a square, each side of which has a length of $q_1$;

the light receiving surface has a shape of a square, each side of which has a length of $q_2$; and the following expression is satisfied:

$$|\beta_1| \times q_1 < 1.7 \times \frac{q_2}{|\beta_2|}$$

where $\beta_1$ represents an optical magnification of the illumination optical system on an assumption that the light emitting surface is an object point and that a surface of the image bearing member is an image plane, and $\beta_2$ represents an optical magnification of the light receiving optical system on an assumption that the surface of the image bearing member is an object point and that the light receiving surface is an image plane.

10. An image information detecting apparatus according to claim 6, wherein one of the following expressions is satisfied:

$$1.2 \leq \frac{|\beta_1| \times |\beta_2| \times q_1}{q_2}$$

and $$1.2 \leq \frac{q_2}{|\beta_1| \times |\beta_2| \times q_1}.$$

11. A color image forming apparatus, comprising:

the image information detecting apparatus according to claim 6; and multiple photosensitive drums.

* * * * *